US006896767B2

(12) United States Patent
Wilhelm

(10) Patent No.: US 6,896,767 B2
(45) Date of Patent: May 24, 2005

(54) EMBOSSED TISSUE PRODUCT WITH IMPROVED BULK PROPERTIES

(75) Inventor: Lee Wilhelm, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 104 days.

(21) Appl. No.: 10/411,401

(22) Filed: Apr. 10, 2003

(65) Prior Publication Data

US 2004/0200590 A1 Oct. 14, 2004

(51) Int. Cl.[7] ..... D21F 11/14; D21H 27/30

(52) U.S. Cl. ..... 162/117; 162/123; 162/118; 162/205; 428/153; 428/154; 428/537.5

(58) Field of Search ..... 162/109, 111–113, 162/117–118, 123–125, 127–129, 204–207; 428/153–154, 141, 535, 537.5

(56) References Cited

U.S. PATENT DOCUMENTS

| | | | | |
|---|---|---|---|---|
| 3,585,104 A | | 6/1971 | Kleinert | |
| 4,594,130 A | | 6/1986 | Chang et al. | |
| 4,793,838 A | | 12/1988 | Thorne | |
| 4,921,034 A | * | 5/1990 | Burgess et al. | 162/109 |
| 5,595,628 A | | 1/1997 | Gordon et al. | |
| 5,900,114 A | * | 5/1999 | Brown et al. | 162/117 |
| 5,904,812 A | * | 5/1999 | Salman et al. | 162/117 |
| 6,077,390 A | * | 6/2000 | Salman et al. | 162/117 |
| 6,077,590 A | | 6/2000 | Archer et al. | |
| 2004/0101704 A1 | * | 5/2004 | Hermans et al. | 428/535 |
| 2004/0140076 A1 | * | 7/2004 | Hermans et al. | 162/205 |
| 2004/0200590 A1 | * | 10/2004 | Wilhelm | 162/118 |

FOREIGN PATENT DOCUMENTS

| | | | | |
|---|---|---|---|---|
| WO | WO 9953140 A1 | * | 10/1999 | D21H/25/00 |
| WO | WO 200185438 A2 | * | 11/2001 | A61F/13/00 |

* cited by examiner

*Primary Examiner*—José A. Fortuna
(74) *Attorney, Agent, or Firm*—Dority & Manning, P.A.

(57) ABSTRACT

Embossed and rolled tissue products are disclosed. In particular, an embossing pattern is used that enhances the softness and bulk of a tissue product without a substantial degradation in strength. The embossing patterns of the present invention are particularly well suited for use with bath tissues and with webs that have not been through-air dried. The web can be, for instance, a wet-pressed web that has been creped.

40 Claims, 18 Drawing Sheets

EMBOSSED TISSUE PRODUCT WITH IMPROVED BULK PROPERTIES

BACKGROUND OF THE INVENTION

In the manufacture of tissue products such as bath tissue, a wide variety of product characteristics must be given attention in order to provide a final product with the appropriate blend of attributes suitable for the product's intended purposes. Improving the softness of tissues is a continuing objective in tissue manufacture. Softness, however, is a perceived property of tissues comprising many factors including thickness, smoothness, fuzziness, and the like.

Traditionally, tissue products have been made using a wet-pressing process in which a significant amount of water is removed from a wet-laid web by pressing the web prior to final drying. In one embodiment, for instance, while supported by an absorbent papermaking felt, the web is squeezed between the felt and the surface of a rotating heated cylinder (Yankee dryer) using a pressure roll as the web is transferred to the surface of the Yankee dryer for final drying. The dried web is thereafter dislodged from the Yankee dryer with a doctor blade (creping), which serves to partially debond the dried web by breaking many of the bonds previously formed during the wet-pressing stages of the process. Creping generally improves the softness of the web, albeit at the expense of a loss in strength.

Recently, throughdrying has increased in popularity as a means of drying tissue webs. Throughdrying provides a relatively noncompressive method of removing water from the web by passing hot air through the web until it is dry. More specifically, a wet-laid web is transferred from the forming fabric to a coarse, highly permeable throughdrying fabric and retained on the throughdrying fabric until it is at least almost completely dry. The resulting dried web is softer and bulkier than a wet-pressed sheet because fewer papermaking bonds are formed and because the web is less dense. Squeezing water from the wet web is eliminated, although subsequent transfer of the web to a Yankee dryer for creping is still often used to final dry and/or soften the resulting tissue.

Currently, a need exists for a process for producing wet-pressed tissue products and creped tissue products that have properties and characteristics more similar to through-air dried webs. Further, a need also exists for producing tissue webs that are capable of maintaining relatively high bulk even when wound into a rolled product. Specifically, base sheets tend to lose a noticeable amount of bulk due to the compressive forces that are exerted on the sheets during winding and converting. As such, a need also exists for a process for producing a tissue product that has both softness and bulk when spirally wound to a particular and desired roll firmness.

DEFINITIONS

A tissue product as described in this invention is meant to include paper products made from base webs such as bath tissues, facial tissues, paper towels, industrial wipers, food-service wipers, napkins, medical pads, and other similar products.

Roll bulk is calculated as follows:

$$\text{Roll Bulk } (\text{cm}^3/\text{g}) = \frac{2500 \text{ pi}(D^2 - d^2)}{BLC}$$

where:

pi=3.142

D=Roll diameter (cm)

d=Core diameter (cm)

B=Bone Dry basis weight ($g/m^2$)

L=Sheet length (cm)

C=Sheet count per roll

For various rolled products of this invention, the bulk of the sheet on the roll can be about 11.5 cubic centimeters per gram or greater, preferably about 12 cubic centimeters per gram or greater, more preferably about 13 centimeters per gram or greater, and even more preferably about 14 centimeters per gram or greater.

The Caliper as used herein is the thickness of a single sheet, but measured as the thickness of a stack of ten sheets and dividing the ten-sheet thickness by ten, where each sheet within the stack is placed with the same side up. Caliper is expressed in mm. It is measured in accordance with STM 3001. In accordance with STM 3001, a loading pressure of 2.0 kPa is placed on a stack of sheets. An instrument capable of measuring caliper, for instance, is model 200-A Microgage manufactured by Emveco. When using the above instrument, the pressure foot is 56.42 mm in diameter and the pressure foot lowering speed is 0.8 mm/sec.

Geometric mean tensile strength (GMT) is the square root of the product of the machine direction tensile strength and the cross-machine direction tensile strength of the web. Geometric tensile strengths are measured using a MTS Synergy tensile tester or other suitable device using a 3 inches sample width, a jaw span of 2 inches, and a crosshead speed of 10 inches per minute after maintaining the sample under TAPPI conditions for 4 hours before testing. A 50 Newton maximum load cell is utilized in the tensile test instrument.

The Kershaw Test is a test used for determining roll firmness. The Kershaw Test is described in detail in U.S. Pat. No. 6,077,590 to Archer, et al., which is incorporated herein by reference. FIG. 16 illustrates the apparatus used for determining roll firmness. The apparatus is available from Kershaw Instrumentation, Inc., Swedesboro, N.J., and is known as a Model RDT-2002 Roll Density Tester. Shown is a towel or bath tissue roll 200 being measured, which is supported on a spindle 202. When the test begins a traverse table 204 begins to move toward the roll. Mounted to the traverse table is a sensing probe 206. The motion of the traverse table causes the sensing probe to make contact with the towel or bath tissue roll. The instant the sensing probe contacts the roll, the force exerted on the load cell will exceed the low set point of 6 grams and the displacement display will be zeroed and begin indicating the penetration of the probe. When the force exerted on the sensing probe exceeds the high set point of 687 grams, the value is recorded. After the value is recorded, the traverse table will stop and return to the starting position. The displacement display indicates the displacement/penetration in millimeters. The tester will record this reading. Next the tester will rotate the tissue or towel roll 90 degrees on the spindle and repeat the test. The roll firmness value is the average of the two readings. The test needs to be performed in a controlled environment of 73.4±1.8 degrees F. and 50±2% relative humidity. The rolls to be tested need to be introduced to this environment at least 4 hours before testing.

Papermaking fibers, as used herein, include all known cellulosic fibers or fiber mixes comprising cellulosic fibers. Fibers suitable for making the webs of this invention comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody fibers such as those obtained from deciduous and coniferous trees, including softwood fibers, such as northern and southern softwood kraft fibers; hardwood fibers, such as eucalyptus, maple, birch, and aspen. Woody fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898, issued Dec. 27, 1988, to Laamanen et al.; U.S. Pat. No. 4,594,130, issued Jun. 10, 1986, to Chang et al.; and U.S. Pat. No. 3,585,104. Useful fibers can also be produced by anthraquinone pulping, exemplified by U.S. Pat. No. 5,595,628, issued Jan. 21, 1997, to Gordon et al.

A portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is Pulpex®, available from Hercules, Inc. (Wilmington, Del.). Synthetic cellulose fiber types include rayon in all its varieties and other fibers derived from viscose or chemically modified cellulose.

Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other papermaking fibers that can be used in the present invention include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

SUMMARY OF THE INVENTION

The present invention is generally directed to the production of spirally wound paper products, such as tissue products that have a relatively high amount of bulk at consumer desired roll firmness values. In one embodiment, for instance, the present invention is directed to a rolled tissue product comprising a base sheet spirally wound into a roll. The base sheet includes at least one ply that has a basis weight of less than about 40 gsm, such as from about 10 gsm to about 40 gsm. The ply contains pulp fibers and was manufactured without being through-air dried.

In accordance with the present invention, the sheet defines an embossed background pattern formed into a surface of the ply. The embossed sheet has a geometric mean tensile strength of less than about 1,400 g/3 inches. The embossed background pattern formed into the sheet produces a wound roll that has a roll bulk in relation to a Kershaw roll firmness such that:

$$\text{Roll bulk } (cm^3/g) > 1.55 * \text{Kershaw Roll Firmness}(g) + 3.7$$

In general, the embossed background pattern comprises a pattern of discrete shapes. For instance, the discrete shapes can be present in an amount of 50 to 400 shapes per square inch, particularly 150 shapes per square inch, such as from about 150 shapes per square inch to about 250 shapes per square inch. The shapes can have a maximum dimension of from about 0.03 inches to about 0.10 inches.

In one embodiment, the discrete shapes may appear in rows. The shapes can be spaced from about 0.04 inches to about 0.09 inches apart in each row from a center of one shape to a center of an adjacent shape. Further, the rows may be spaced from about 0.06 inches to about 0.13 inches apart from a center of one row to a center of an adjacent row. The rows can be substantially linear or can have a wave-like shape. Examples of wave-like shapes include sine waves, zigzag waves, helix-shaped waves, and the like. Helix-shaped waves may be produced by applying a pattern spirally to an embossing roll. For example, in one embodiment, a pattern can be spirally positioned on an embossing roll such that the pattern only repeats once during a rotation of the roll. Thus, helix-shaped waves have a pattern similar to the threads on a screw.

The base sheet described above can be a single-ply base sheet or can include multiple plies, such as two plies. When containing multiple plies, one ply can be embossed as described above or all of the plies can include the embossing pattern. The plies can be embossed together or can be embossed separately. Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the specification, including reference to the accompanying Figures in which.

Figure 1:
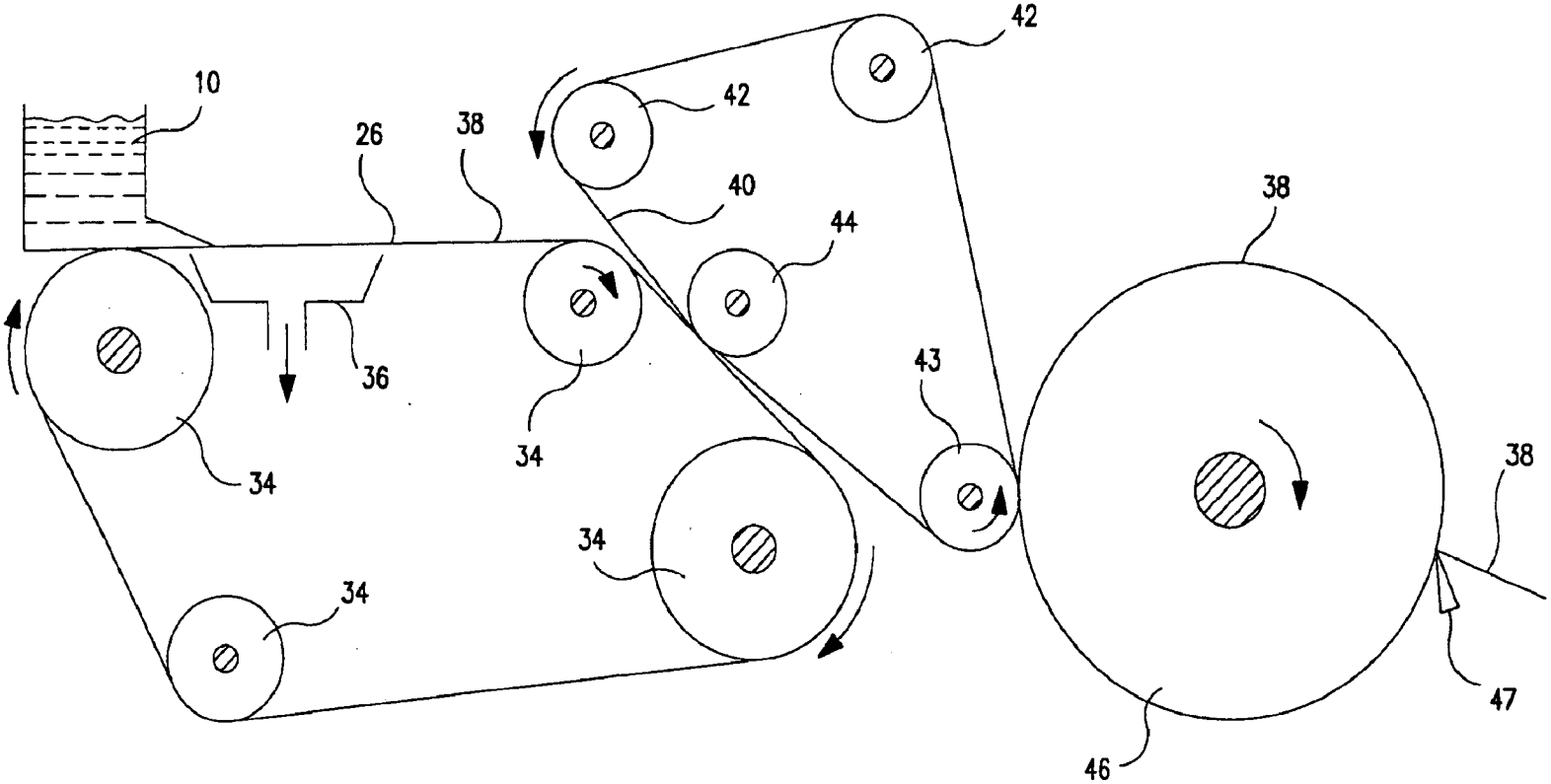
FIG. 1 is a cross-sectional view of one embodiment of a process for making paper webs for use in the present invention.

Repeated use of reference characters in the present specification and drawings is intended to represent the same or analogous features or elements of the present invention.

DETAILED DESCRIPTION OF THE INVENTION

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a process for producing spirally-wound tissue products, such as bath tissues. Through the process of the present invention, the spirally-wound products have a unique combination of properties that represent various improvements over prior art constructions. Specifically, wound products made according to the present invention have a consumer-desired amount of roll firmness and bulk, while still maintaining sheet softness and strength properties. Of particular advantage, wet-pressed tissue products and other tissue products that have not been through-air dried can be produced according to the present invention so as to have bulk properties that are similar to uncreped, through-air dried webs.

In general, the improved properties of tissue products made according to the present invention are achieved by embossing the tissue products according to a particular background pattern. The embossing patterns of the present invention have been found to produce unusually high bulk for given levels of strength degradation. In other words, the embossing patterns of the present invention have been found to provide the greatest bulk for a given level of strength.

For instance, it has been discovered by the present inventor that tissue products, particularly bath tissue products, that are manufactured without being through-air dried and which have a geometric mean tensile strength of less than about 1,400 g/3 inches can be embossed according to the present invention so as to have a roll bulk in relation to Kershaw roll firmness as follows:

$$\text{Roll bulk } (cm^3/g) > 1.55 * \text{Kershaw Roll Firmness}(g) + 3.7$$

Figure 3:
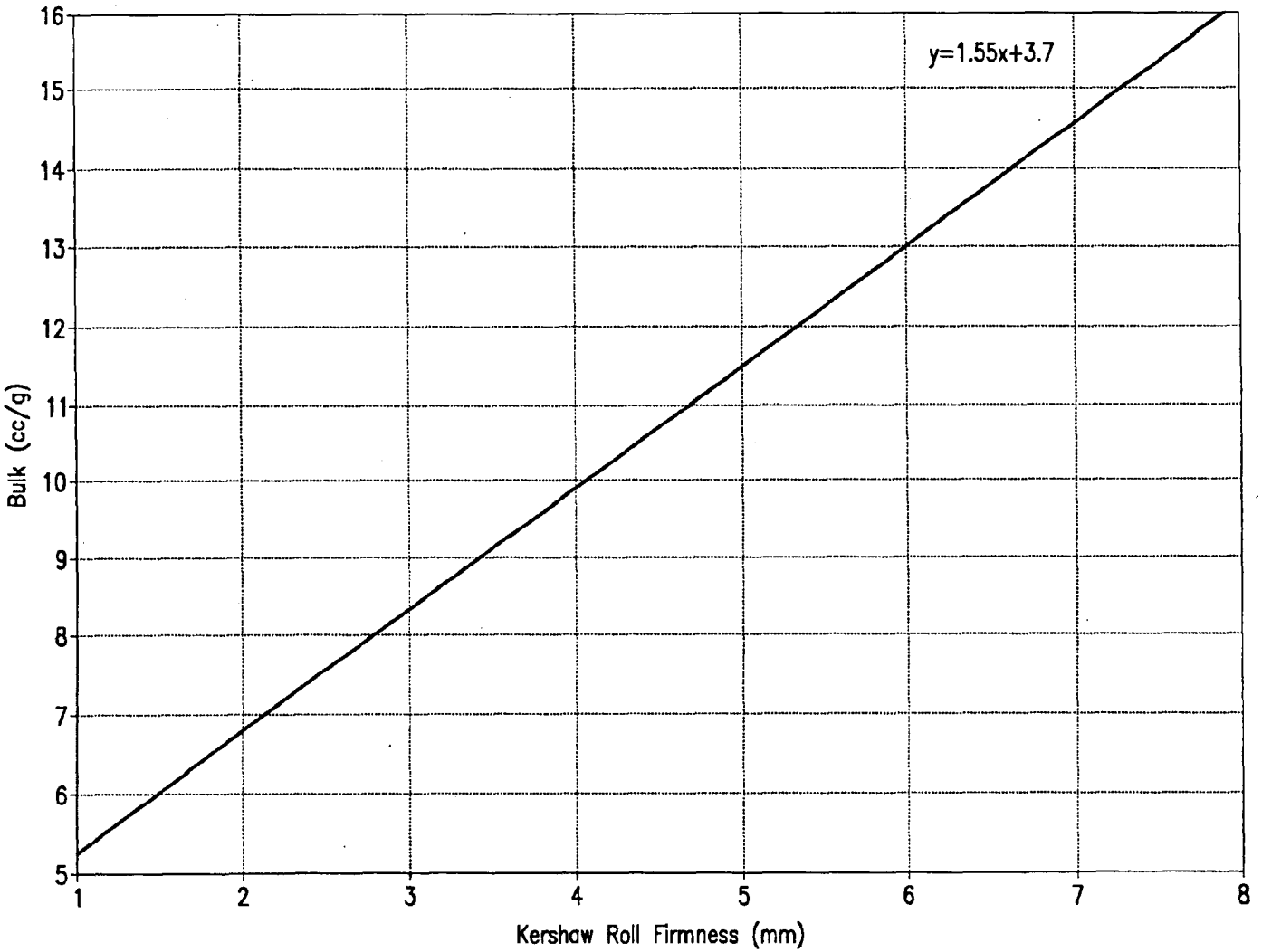
FIG. 3 is a graph showing the relationship between roll bulk and Kershaw roll firmness of products made in accordance with the present invention.

The above relationship is graphically illustrated in FIG. 3. In general, rolled products made according to the present invention can have a Kershaw roll firmness of from about 1 mm to about 10 mm. At these firmness values, the wound roll can have a roll bulk of from about 5 cc/g to about 19 cc/g.

Base webs that may be used in the process of the present invention can vary depending upon the particular application. In general, any suitably made base web may be used in the process of the present invention. Further, the webs can be made from any suitable type of fiber. For instance, the base web can be made from pulp fibers, other natural fibers, synthetic fibers, and the like.

Papermaking fibers useful for purposes of this invention include any cellulosic fibers which are known to be useful for making paper, particularly those fibers useful for making relatively low density papers such as facial tissue, bath tissue, paper towels, dinner napkins and the like. Suitable fibers include virgin softwood and hardwood fibers, as well as secondary or recycled cellulosic fibers, and mixtures thereof. Especially suitable hardwood fibers include eucalyptus and maple fibers. As used herein, secondary fibers means any cellulosic fiber which has previously been isolated from its original matrix via physical, chemical or mechanical means and, further, has been formed into a fiber web, dried to a moisture content of about 10 weight percent or less and subsequently re-isolated from its web matrix by some physical, chemical or mechanical means.

Paper webs made in accordance with the present invention can be made with a homogeneous fiber furnish or can be formed from a stratified fiber furnish producing layers within the single ply product. Stratified base webs can be formed using equipment known in the art, such as a multi-layered headbox. Both strength and softness of the base web can be adjusted as desired through layered tissues, such as those produced from stratified headboxes.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present invention includes a first outer layer and a second outer layer containing primarily hardwood fibers. The hardwood fibers can be mixed, if desired, with paper broke in an amount up to about 10% by weight and/or softwood fibers in an amount up to about 10% by weight. The base web further includes a middle layer positioned in between the first outer layer and the second outer layer. The middle layer can contain primarily softwood fibers. If desired other fibers, such as high-yield fibers or synthetic fibers may be mixed with the softwood, fibers in an amount up to about 10% by weight.

When constructing a web from a stratified fiber furnish, the relative weight of each layer can vary depending upon the particular application. For example, in one embodiment, when constructing a web containing three layers, each layer can be from about 15% to about 40% of the total weight of the web, such as from about 25% to about 35% of the weight of the web.

The tissue product of the present invention can generally be formed by any of a variety of papermaking processes known in the art. In fact, any process capable of forming a paper web that does not utilize through-air drying can be utilized in the present invention. For example, a papermaking process of the present invention can utilize adhesive creping, wet creping, double creping, embossing, wet-pressing, air pressing, as well as other steps in forming the paper web.

The present invention is directed to improving the properties of base webs that have not been through-air dried or otherwise molded in the wet state. Specifically, it has been found that the present invention is particularly well suited to using base sheets formed from a wet-pressed papermaking process. The properties of such sheets can be significantly improved through the use of the embossing pattern of the present invention.

For example, referring to FIG. 1, one embodiment of a process for producing a wet-pressed base web that may be used in accordance with the present invention is illustrated.

As shown in FIG. 1, the web-forming system includes a headbox 10 for receiving an aqueous suspension of fibers. Headbox 10 spreads the aqueous suspension of fibers onto a forming fabric 26 that is supported and driven by a plurality of guide rolls 34. A vacuum box 36 is disposed beneath forming fabric 26 and is adapted to remove water from the fiber furnish to assist in forming a web.

From forming fabric 26, a formed web 38 is transferred to a second fabric 40, which may be either a wire or a felt. Fabric 40 is supported for movement around a continuous path by a plurality of guide rolls 42. Also included is a pick up roll 44 designed to facilitate transfer of web 38 from fabric 26 to fabric 40. The speed at which fabric 40 can be driven is approximately the same speed at which fabric 26 is driven so that movement of web 38 through the system is consistent. Alternatively, the two fabrics can be run at different speeds, such as in a rush transfer process, in order to increase the bulk of the webs or for some other purpose.

From fabric 40, web 38, in this embodiment, is pressed onto the surface of a rotatable heated dryer drum 46, such as a Yankee dryer, by a press roll 43. Web 38 is lightly pressed into engagement with the surface of dryer drum 46 to which it adheres, due to its moisture content and its preference for the smoother of the two surfaces. As web 38 is carried through a portion of the rotational path of the dryer surface, heat is imparted to the web causing most of the moisture contained within the web to be evaporated.

Web 38 is then removed from dryer drum 46 by a creping blade 47. Creping web 38 as it is formed reduces internal bonding within the web and increases softness.

Softening agents, sometimes referred to as debonders, can be used to enhance the softness of the tissue product and such softening agents can be incorporated with the fibers before, during or after formation of the aqueous suspension of fibers. Such agents can also be sprayed or printed onto the web after formation, while wet. Suitable agents include, without limitation, fatty acids, waxes, quaternary ammonium salts, dimethyl dihydrogenated tallow ammonium chloride, quaternary ammonium methyl sulfate, carboxylated polyethylene, cocamide diethanol amine, coco betaine, sodium lauryl sarcosinate, partly ethoxylated quaternary ammonium salt, distearyl dimethyl ammonium chloride, polysiloxanes and the like. Examples of suitable commercially available chemical softening agents include, without limitation, Berocell 596 and 584 (quaternary ammonium compounds) manufactured by Eka Nobel Inc., Adogen 442 (dimethyl dihydrogenated tallow ammonium chloride) manufactured by Sherex Chemical Company, Quasoft 203 (quaternary ammonium salt) manufactured by Quaker Chemical Company, and Arquad 2HT-75 (di (hydrogenated tallow) dimethyl ammonium chloride) manufactured by Akzo Chemical Company. Suitable amounts of softening agents will vary greatly with the species selected and the desired results. Such amounts can be, without limitation, from about 0.05 to about 1 weight percent based on the weight of fiber, more specifically from about 0.25 to about 0.75 weight percent, and still more specifically about 0.5 weight percent.

After the web is formed and dried, the tissue product of the present invention undergoes a converting process where the formed base web is wound into a roll for final packaging. Prior to or during this converting process, in accordance with the present invention, the base web of the tissue product is subjected to an embossing process which improves the properties of the web.

Figure 2:
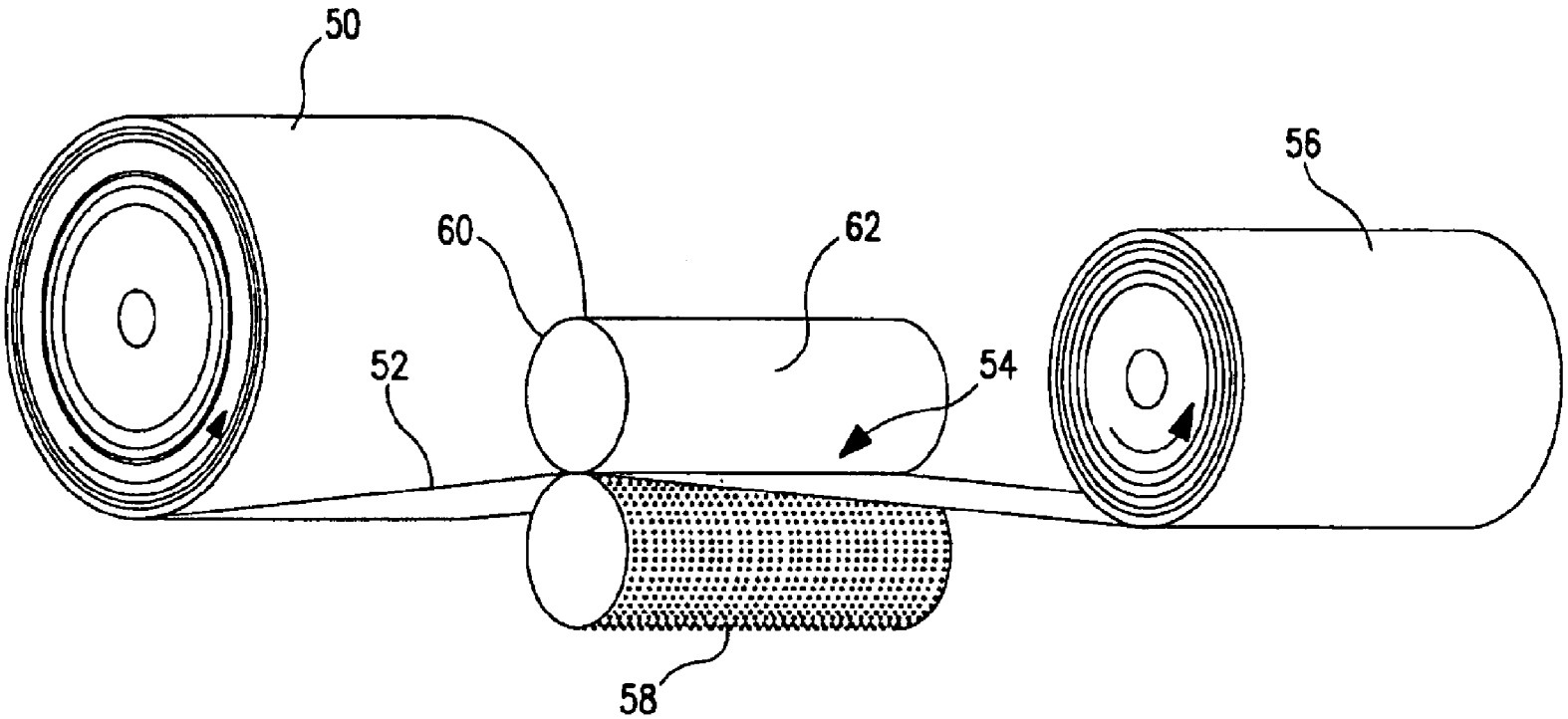
FIG. 2 is a side view of one embodiment of a process for embossing paper webs in accordance with the present invention.

For exemplary purposes only, referring to FIG. 2, one embodiment of a process for embossing a tissue web is shown. As illustrated, a web 52 is unwound from a supply roll 50 and fed through a nip 54 where the web is embossed. After exiting the nip 54, the web 52 is then rewound into a roll 56.

The nip 54 is formed between a pattern roll 58 and a backing roll 60. Pattern roll 58 includes the embossing pattern of the present invention and can be made from any suitable hard material, such as steel. The backing roll 60, on the other hand, can have a hard surface or a compressible surface. For example, backing roll 60 can include a steel surface or, alternatively, can include a rubber coating 62 as shown in FIG. 2. For most applications, base sheets embossed in accordance with the present invention are embossed when substantially dry, such as in a converting process as shown in FIG. 2. For example, for many applications, the base sheet should have a moisture content of no greater than about 6 percent.

Figure 4:
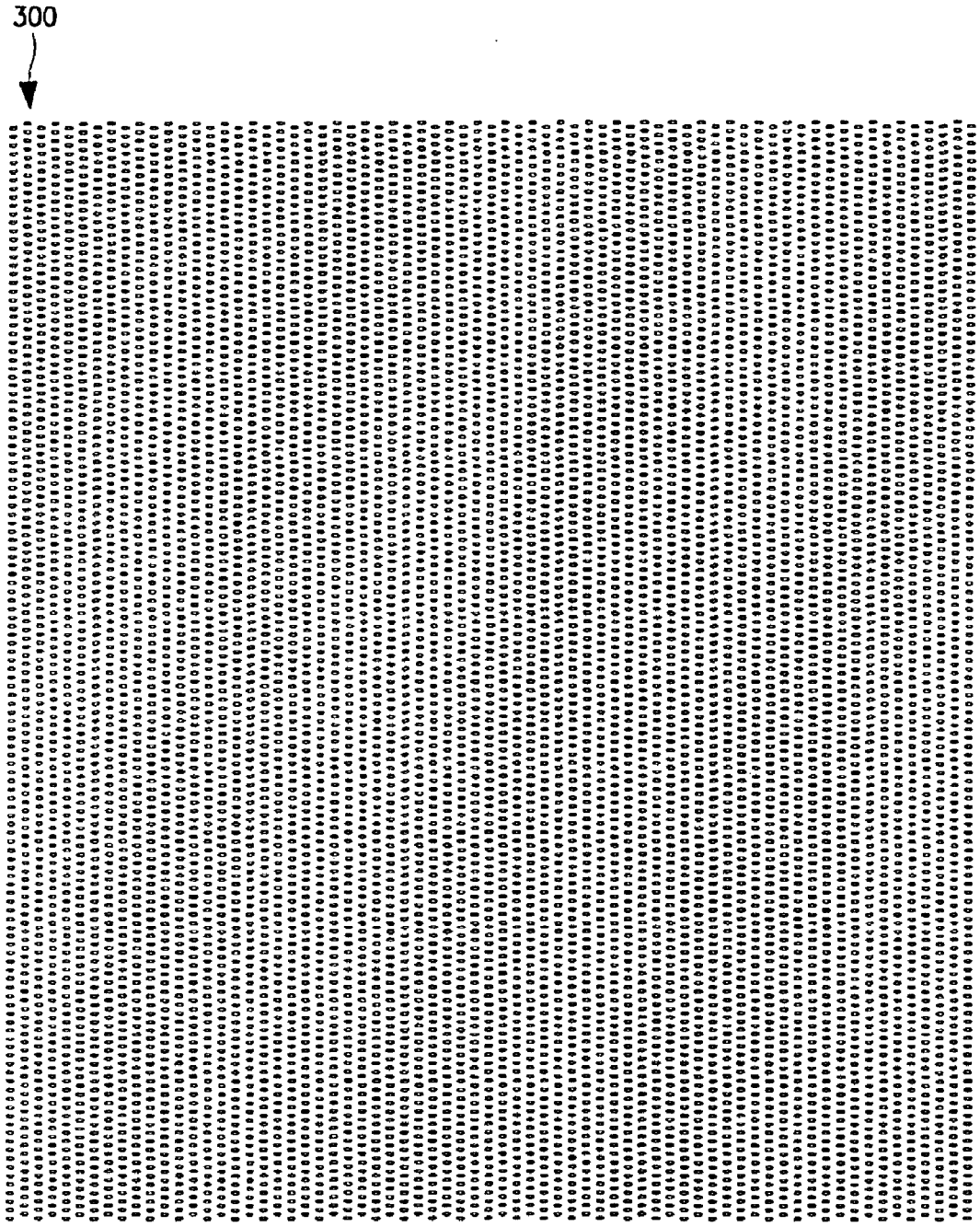
FIGS. 4–14 are different embodiments of embossing patterns that may be used in accordance with the present invention.
Figure 4A:
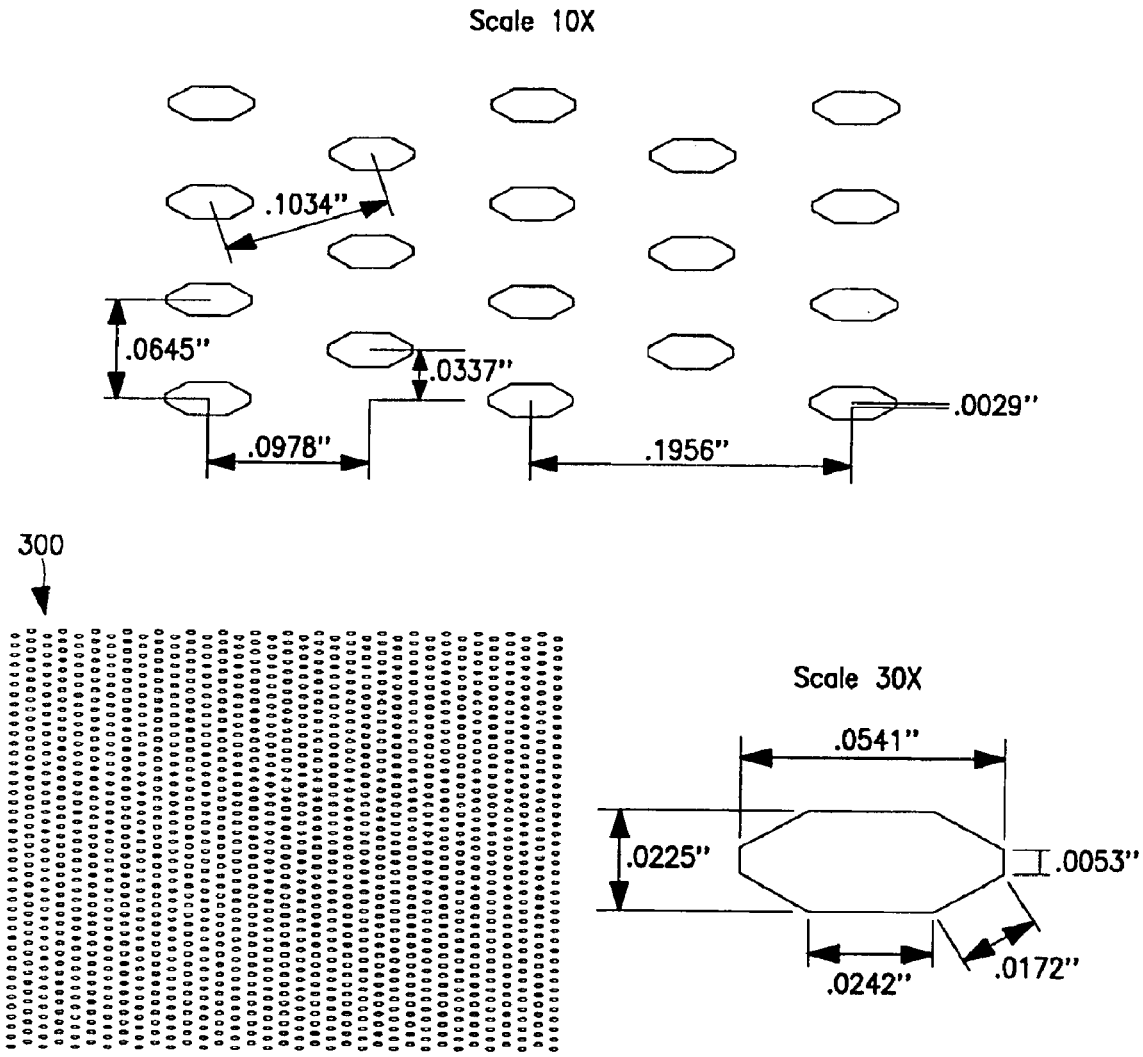

Referring to FIGS. 4 and FIG. 4A, one embodiment of an embossing pattern 300 that may be incorporated into the pattern roll 58 as shown in FIG. 2 in accordance with the present invention is illustrated. As shown, the embossing pattern comprises a plurality of discrete shapes that are somewhat densely spaced together. In this embodiment, the discrete shapes appear in rows that extend in the machine direction. The discrete shapes are offset from each other from row to row. In this embodiment, the open space between the discrete shapes or elements is larger than the elements themselves.

In the embodiment illustrated in FIGS. 4 and 4A, the discrete shapes are present at a density of from about 160 shapes per square inch to about 170 shapes per square inch. Within each row, the discrete shapes are spaced approximately 0.064 inches from the center of one shape to the center of an adjacent shape. The distance between rows is approximately 0.098 inches from the center of one row to the center of an adjacent row. In this embodiment, the discrete elements themselves have a largest dimension of approximately 0.054 inches. The discrete shapes in this embodiment can be considered to have a distorted octagon-like shape. Further dimensions are shown in FIG. 4A.

The embossing pattern illustrated in FIG. 4 represents a base pattern that may be used in accordance with the present invention. The size of the pattern can be increased and decreased. For example, the pattern shown in FIG. 4 can be decreased by 50 percent or increased to twice its size while still retaining many of the benefits of the present invention.

Figure 5:
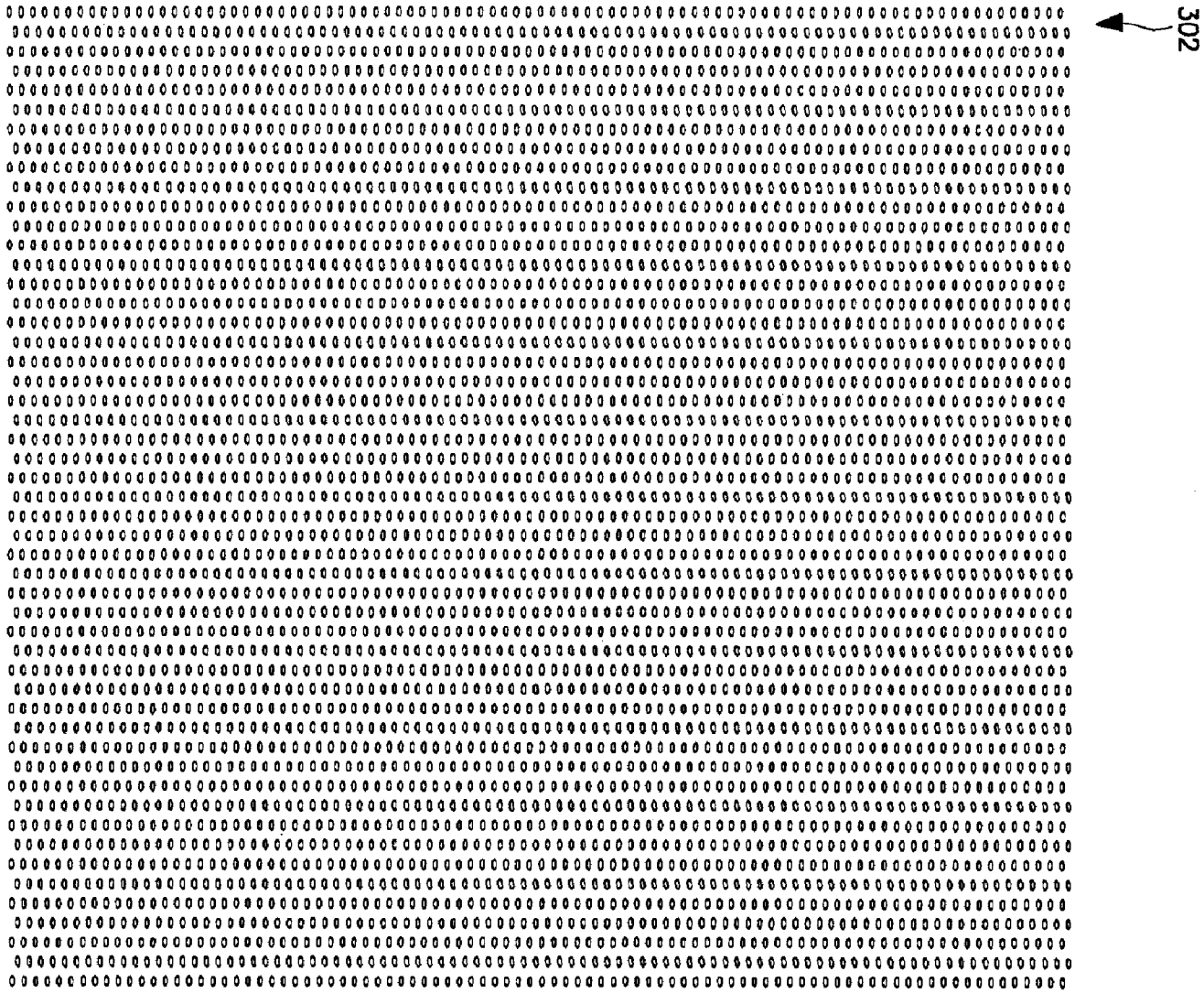
Figure 5A:
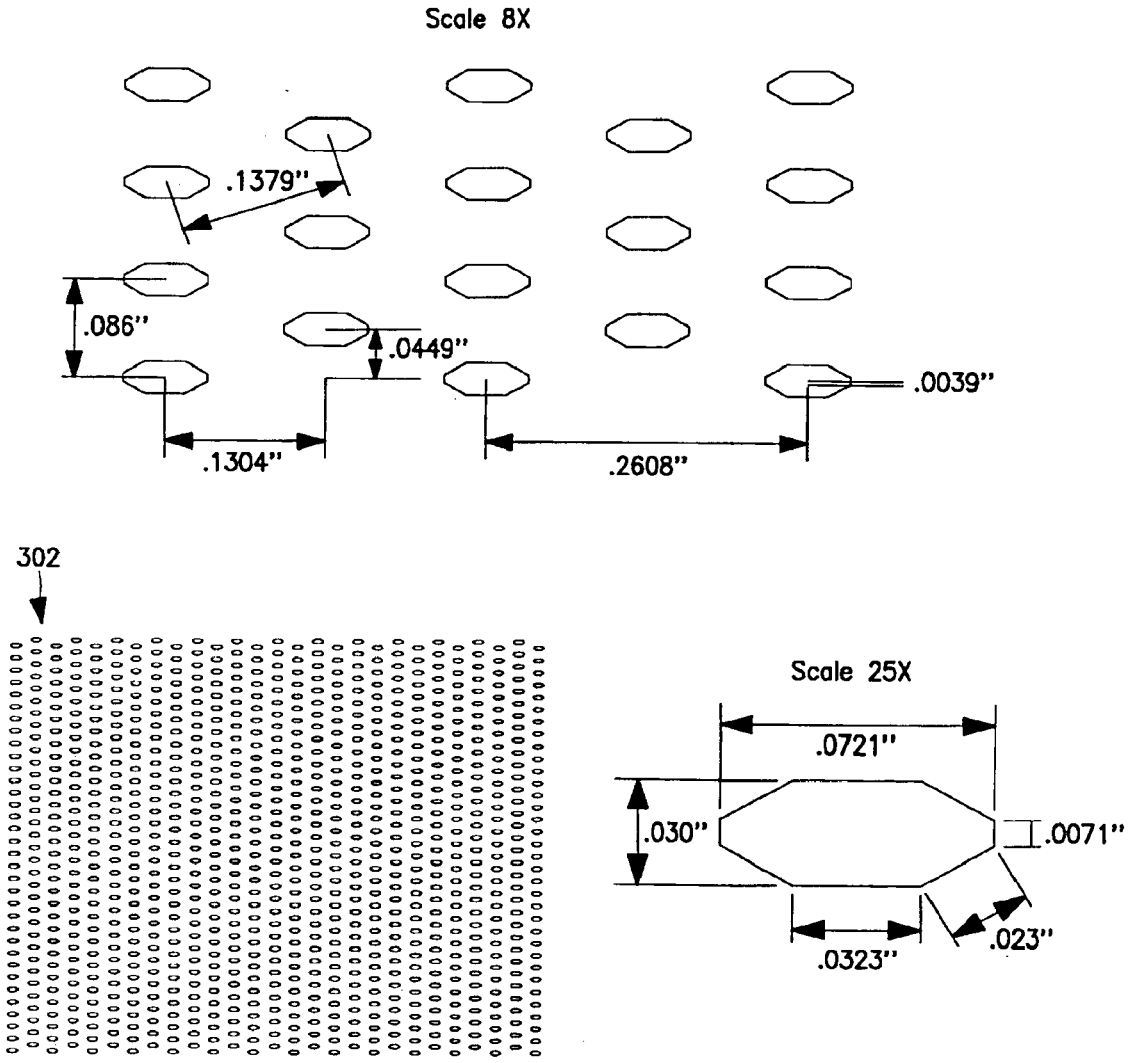

For instance, referring to FIGS. 5 and FIG. 5A, an embossing pattern 302 is shown that is approximately 133 percent larger than the pattern shown in FIG. 4. In the embossing pattern 302, for instance, there are from about 85 discrete shapes per square inch to about 95 discrete shapes per square inch. The patterns in FIGS. 4 and 5, however, are basically reproductions of each other except for the increase in size.

As shown in FIG. 5A, in this embodiment, within each row, the discrete shapes are spaced approximately 0.86 inches from the center of one shape to the center of an adjacent shape. The distance between rows is approximately 0.13 inches from the center of one row to the center of an adjacent row. The discrete elements themselves have a largest dimension of approximately 0.072 inches.

Figure 6:
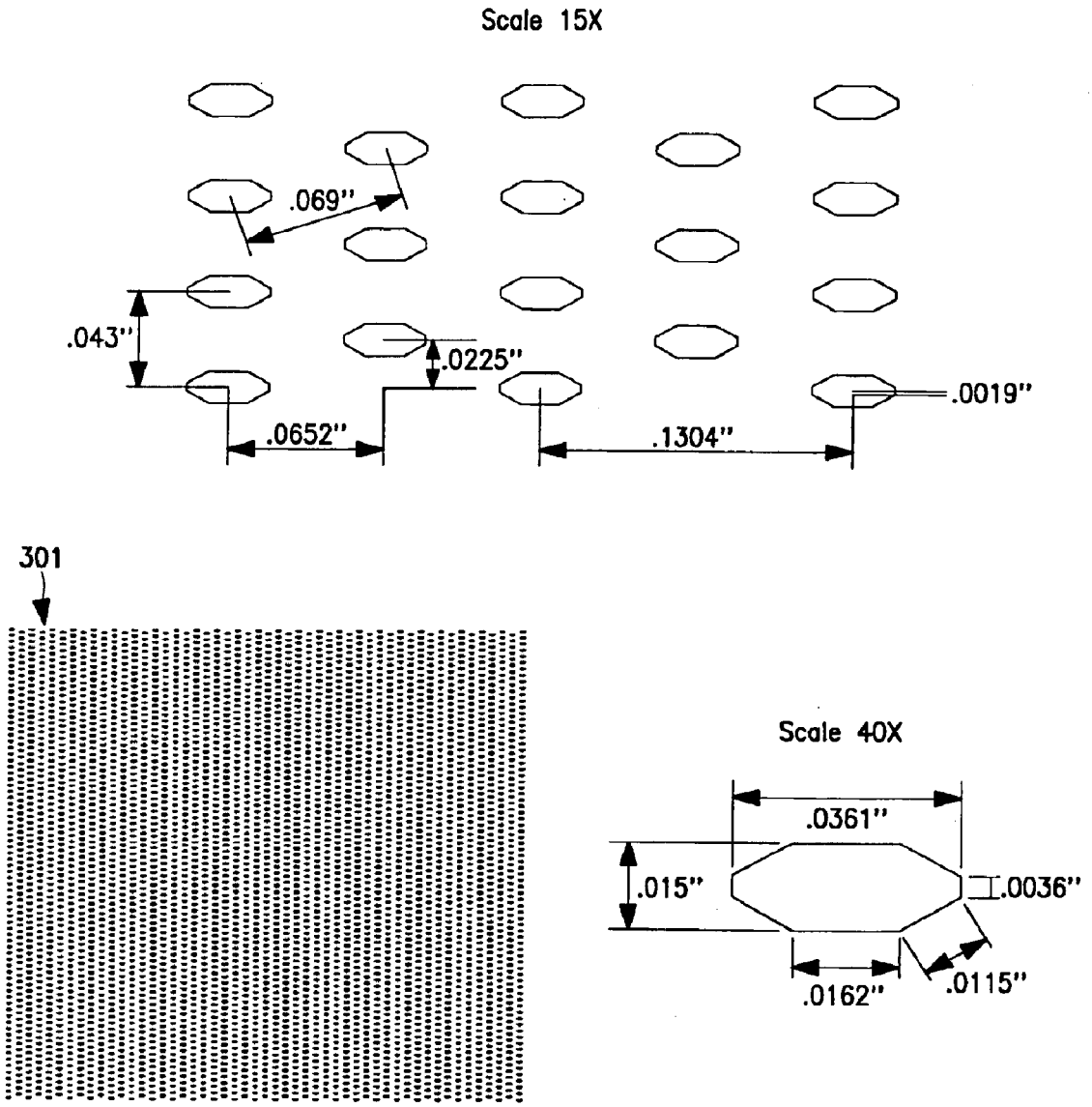

In addition to being enlarged as shown in FIG. 5, the embossing pattern of the present invention can also be reduced as shown in FIG. 6. Referring to FIG. 6, an embossing pattern 301 is shown. In this pattern, the discrete shapes are spaced approximately 0.043 inches from the center of one shape to the center of an adjacent shape in the same row. The distance between rows is approximately 0.07 inches from the center of one row to the center of an adjacent row. The discrete elements have a largest dimension of approximately 0.036 inches.

The size of the embossing pattern used for a particular application can depend on various factors including the basis weight of the substrate, the number of plies included with the substrate, the type of fiber furnished used to make the substrate, and the desired results. For many applications, the embossing pattern used in accordance with the present invention contains from about 50 elements per square inch to about 400 elements per square inch. The elements or discrete shapes can form rows and, within each row, can be spaced from about 0.04 inches to about 0.09 inches apart from the center of one discrete shape to the center of an adjacent discrete shape. The distance between the center of a first row and the center of an adjacent row can be from about 0.06 inches to about 0.013 inches.

The discrete shapes can take on various forms. For example, the discrete shapes can be circular, ovular, or in other suitable geometric formation. In general, the discrete shapes should have a maximum dimension of from about 0.03 inches to about 0.10 inches.

Figure 7:
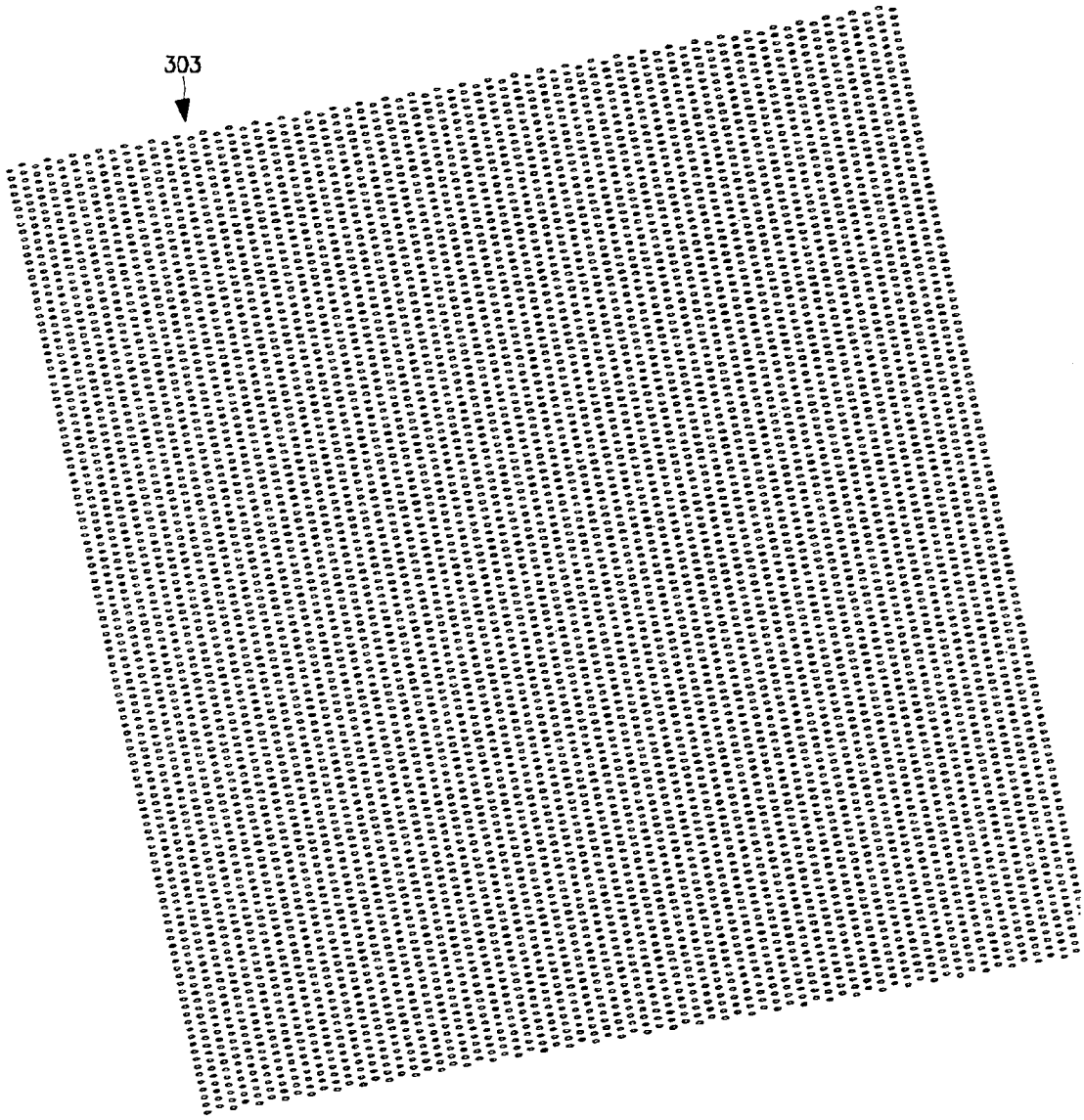

Referring to FIGS. 7–14, various different embodiments of embossing patterns made in accordance with the present invention will now be discussed. For example, referring to FIG. 7, an embossing pattern 303 is shown that is similar to the embossing pattern illustrated in FIG. 4. In FIG. 7, however, the embossing pattern has been shifted so that the rows are diagonal to the machine direction.

Figure 8:
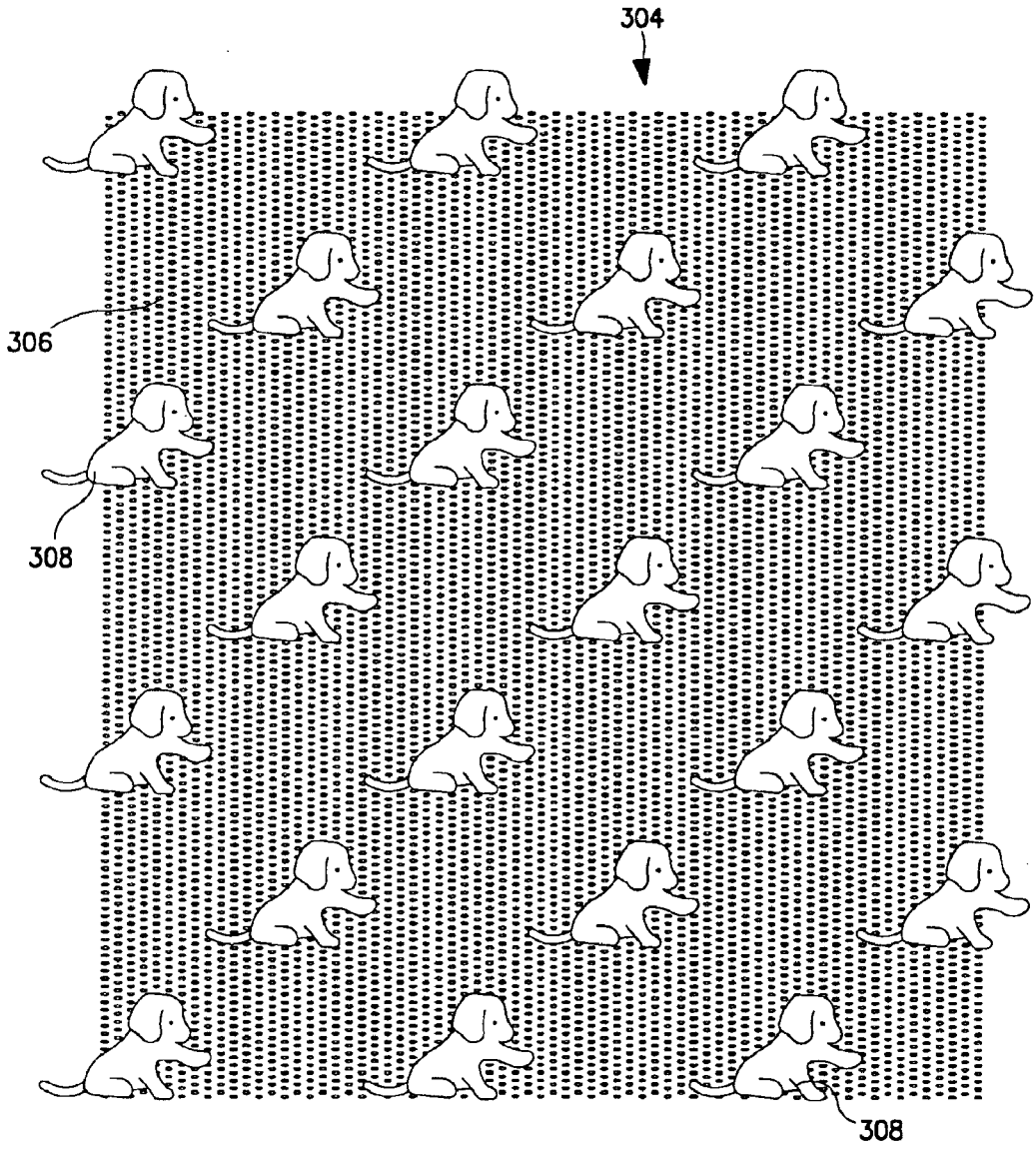

Referring to FIG. 8, another embodiment of an embossing pattern made in accordance with the present invention is illustrated. In this embodiment, the embossing pattern 304 includes a background pattern 306 that is similar to the pattern illustrated in FIG. 4. In this embodiment, however, an additional pattern 308 is combined with the background pattern 306. For example, in this embodiment, the additional pattern 308 comprises diagonal rows of puppies.

The present inventor has discovered that the puppy pattern 308 can be included with the background pattern 306 while still obtaining the advantages and benefits of the present invention. For many applications, however, the background pattern 306 should predominant over any other additional patterns. For example, the background pattern 306 should cover at least about 75 percent of the surface area of the entire pattern, particularly at least 80 percent of the surface area, and more particularly at least 90 percent of the total surface area of the pattern. Otherwise, however, various other patterns and designs can be incorporated into the embossing pattern of the present invention.

Figure 9:
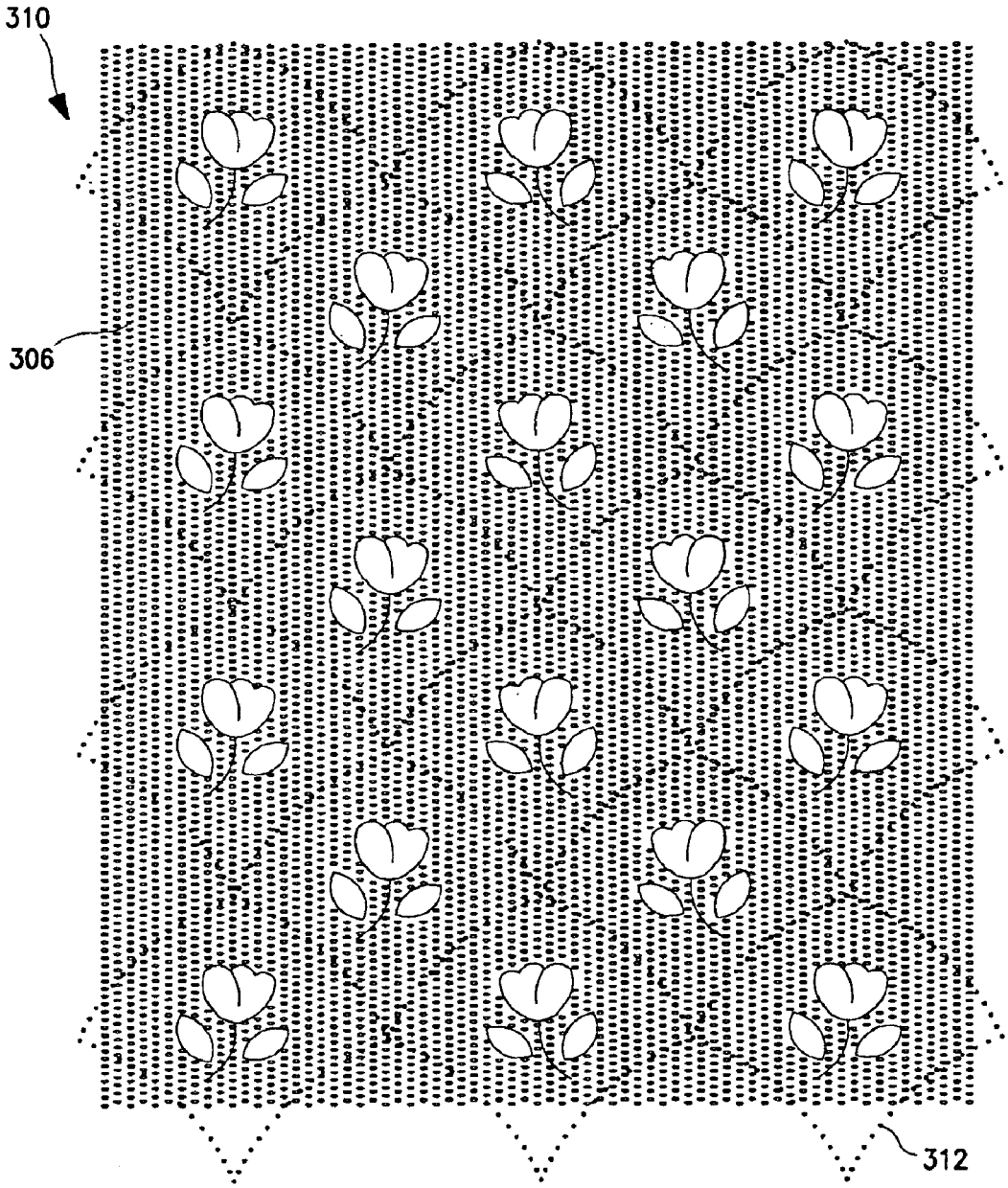

For example, referring to FIG. 9, another embodiment of an embossing pattern 310 made in accordance with the present invention is illustrated. In this embodiment, the background pattern 306 is combined with an additional pattern 312 that comprises flowers appearing in a quilt-like design.

Figure 10:
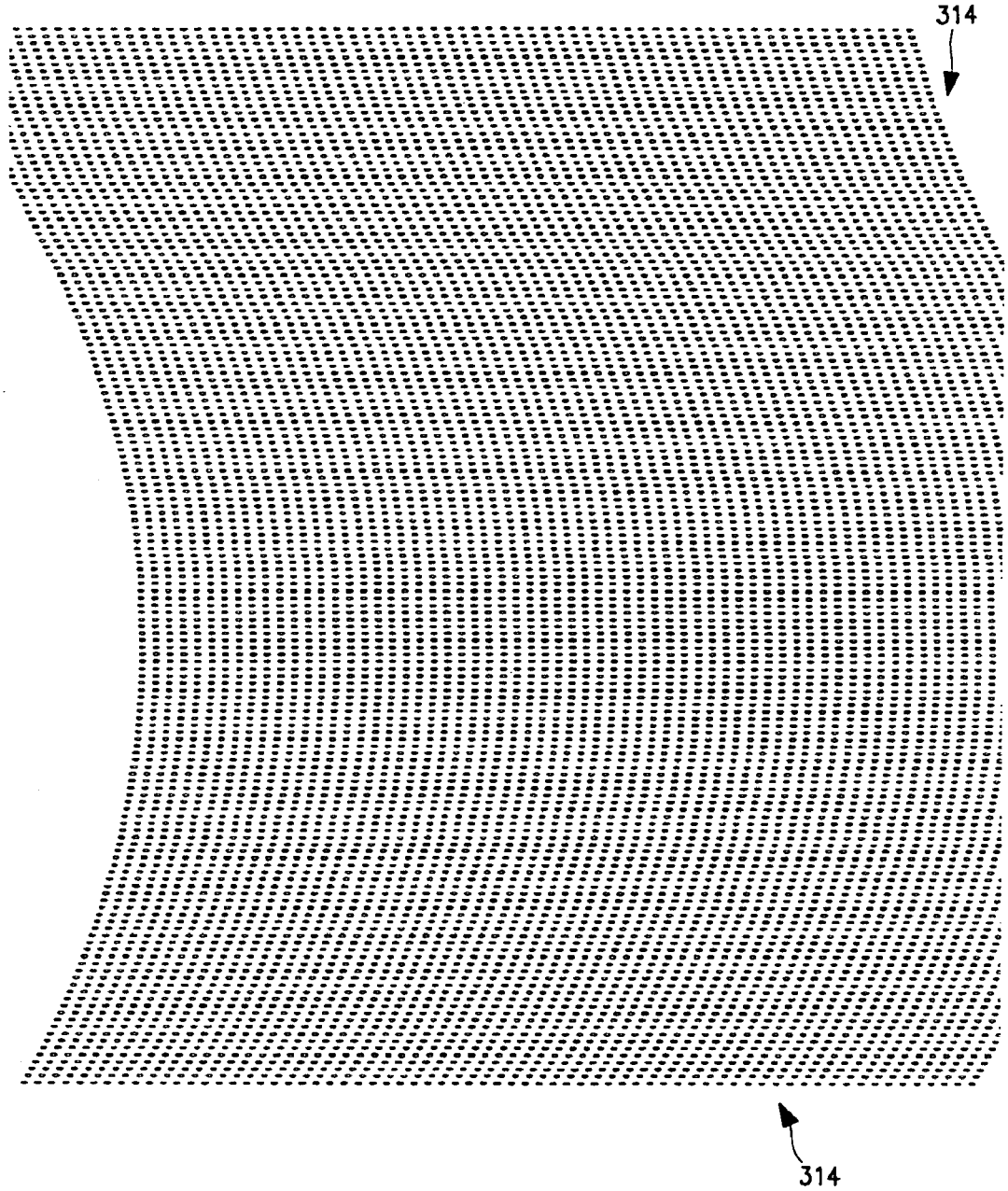

A further embodiment of an embossing pattern 314 is illustrated in FIG. 10. In this embodiment, a wave-like pattern has been incorporated into the embossing pattern illustrated in FIG. 4. Incorporating a wave-like pattern into the rows of discrete shapes may be desirable in some applications to prevent adjacent layers of the tissue product from nesting together. In this regard, various anti-nesting designs can be incorporated into the pattern. In the embodiment illustrated in FIG. 10, the rows of discrete shapes appear in a sinusoidal wave. The sine wave to prevent nesting may have a period and amplitude, for instance, from about 0 inches by 0 inches to about 80 inches by 20 inches, particularly from about 5 inches by 0.6 inches to about 20 inches by 2.4 inches. In one particular embodiment, for instance, the sine wave can have a period and amplitude of 15 inches by 1.82 inches.

Figure 11:
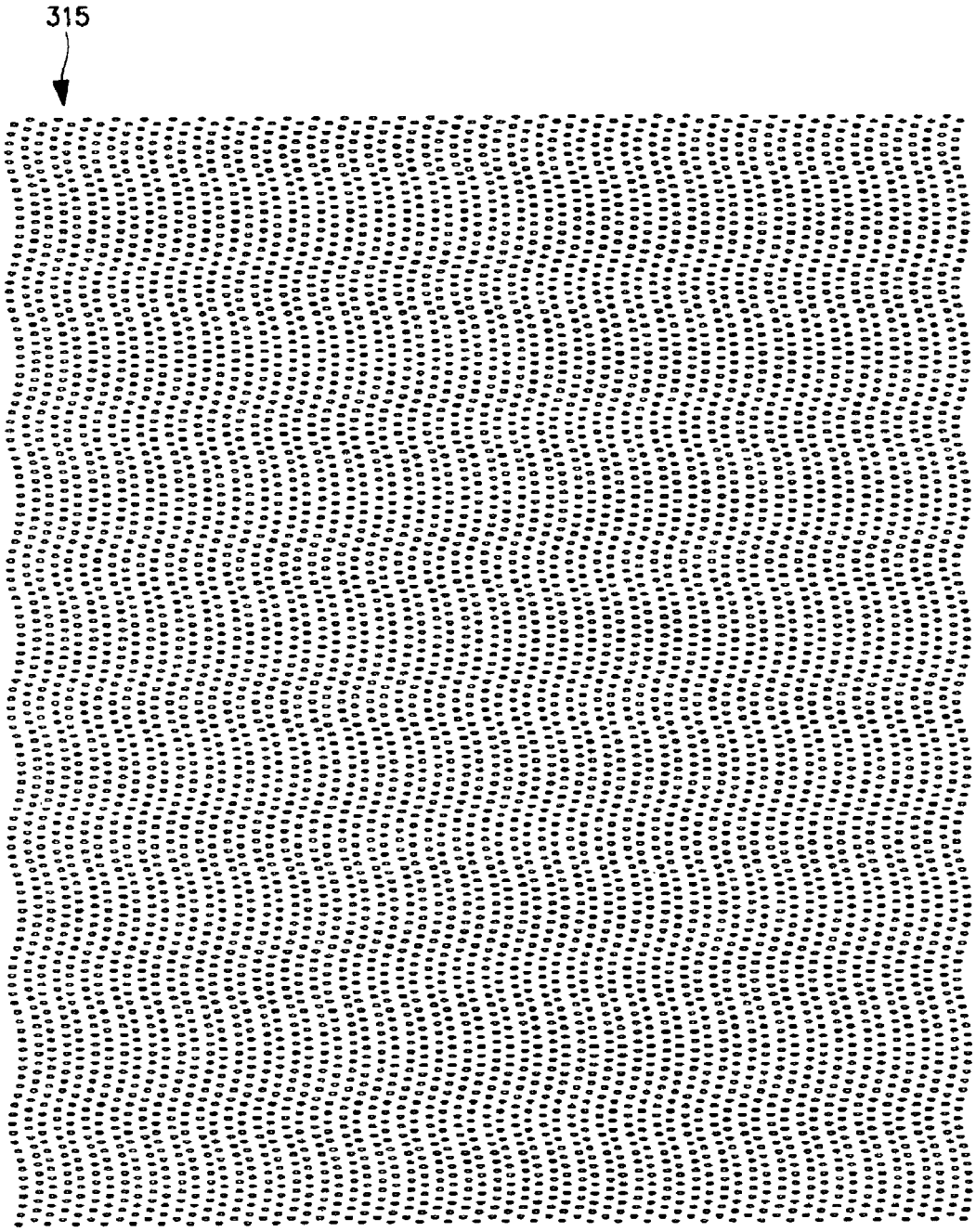

In FIG. 11, an embossing pattern 315 is shown that also includes a wave-like pattern. The sine waves shown in the embossing pattern 315, however, have a much shorter period than the sine waves shown in FIG. 10.

In addition to sine waves, other wave-like designs that can be incorporated into the embossing pattern include zigzag-like designs and helix-like designs.

Figure 12:
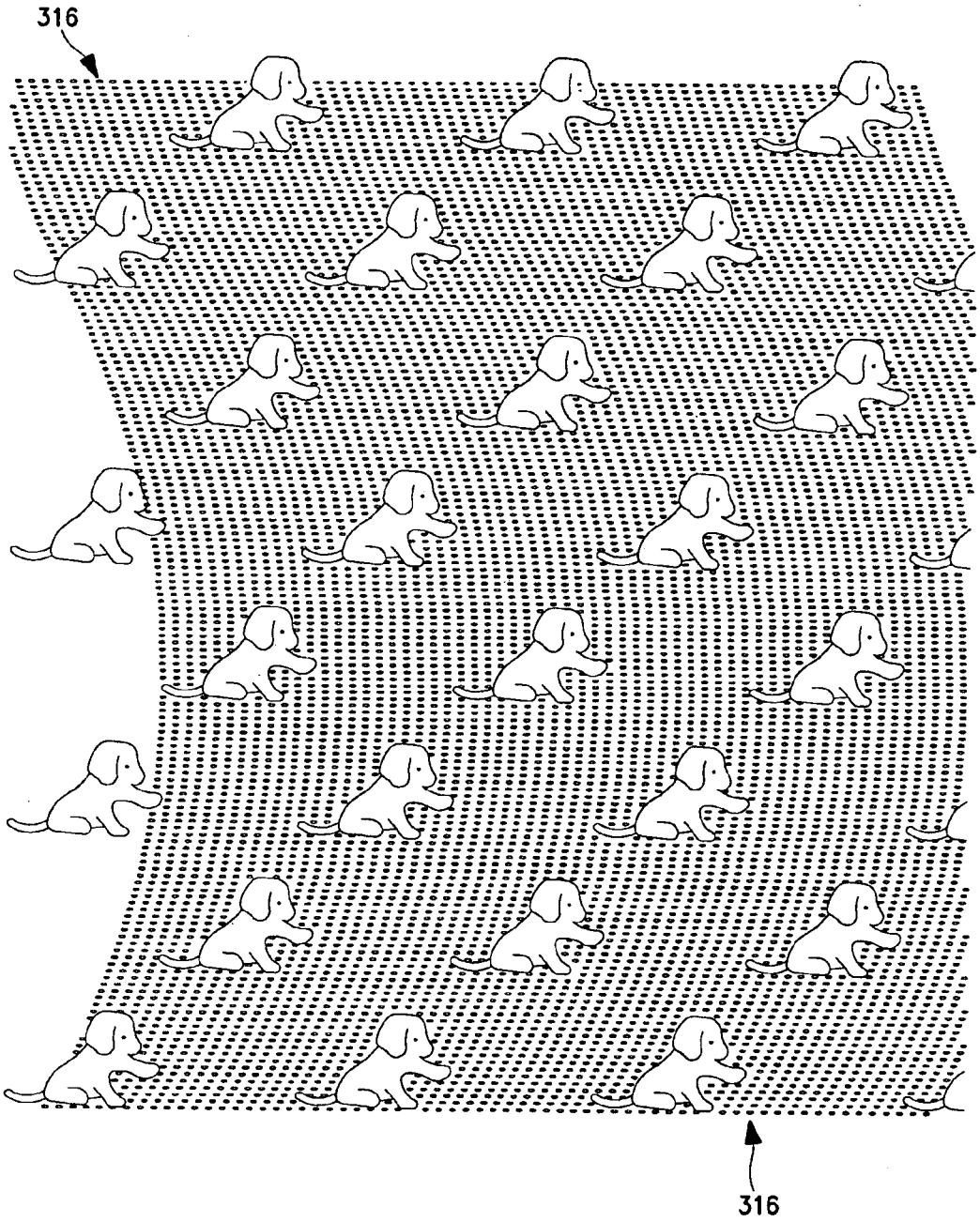
Figure 13:
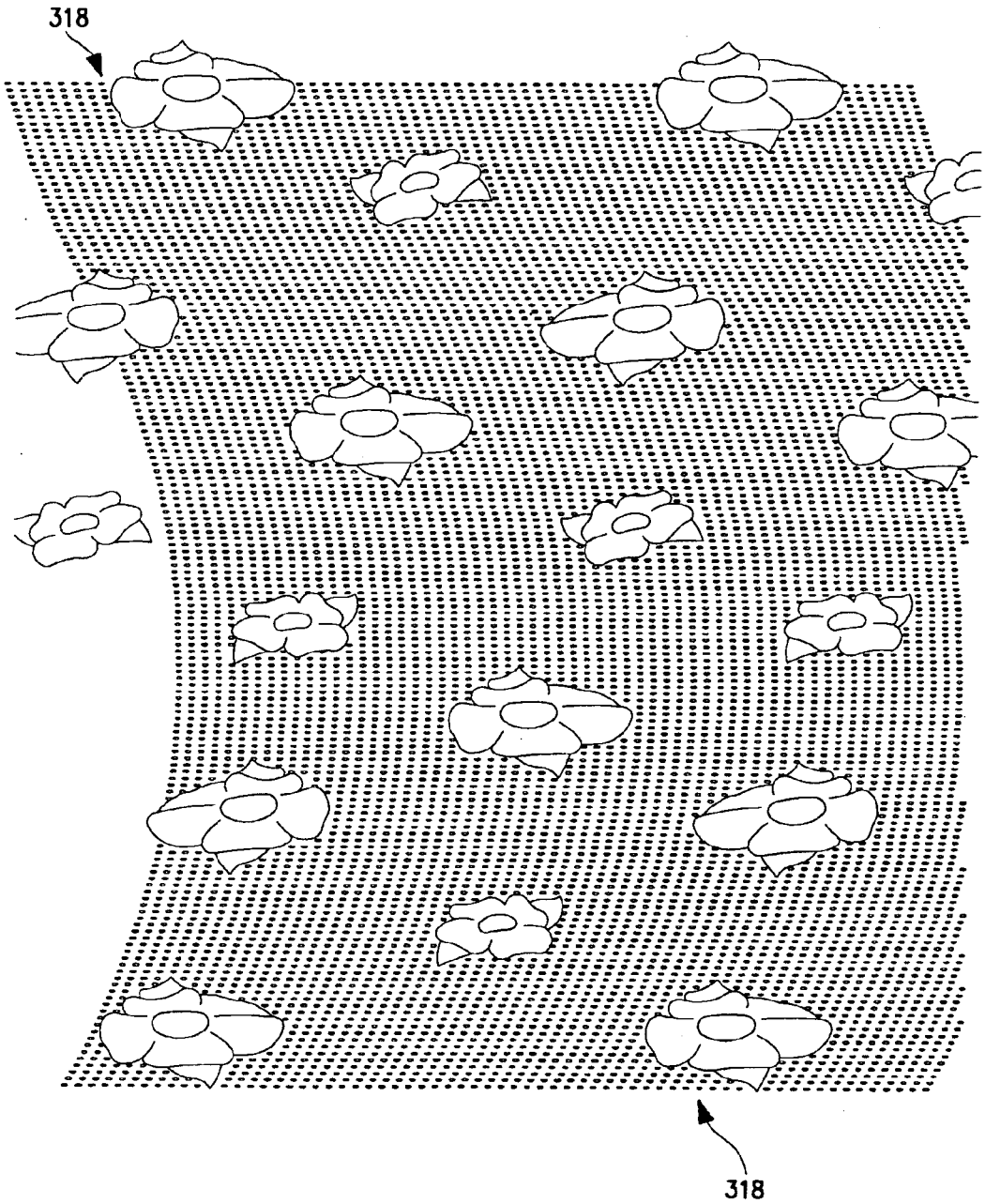
Figure 14:
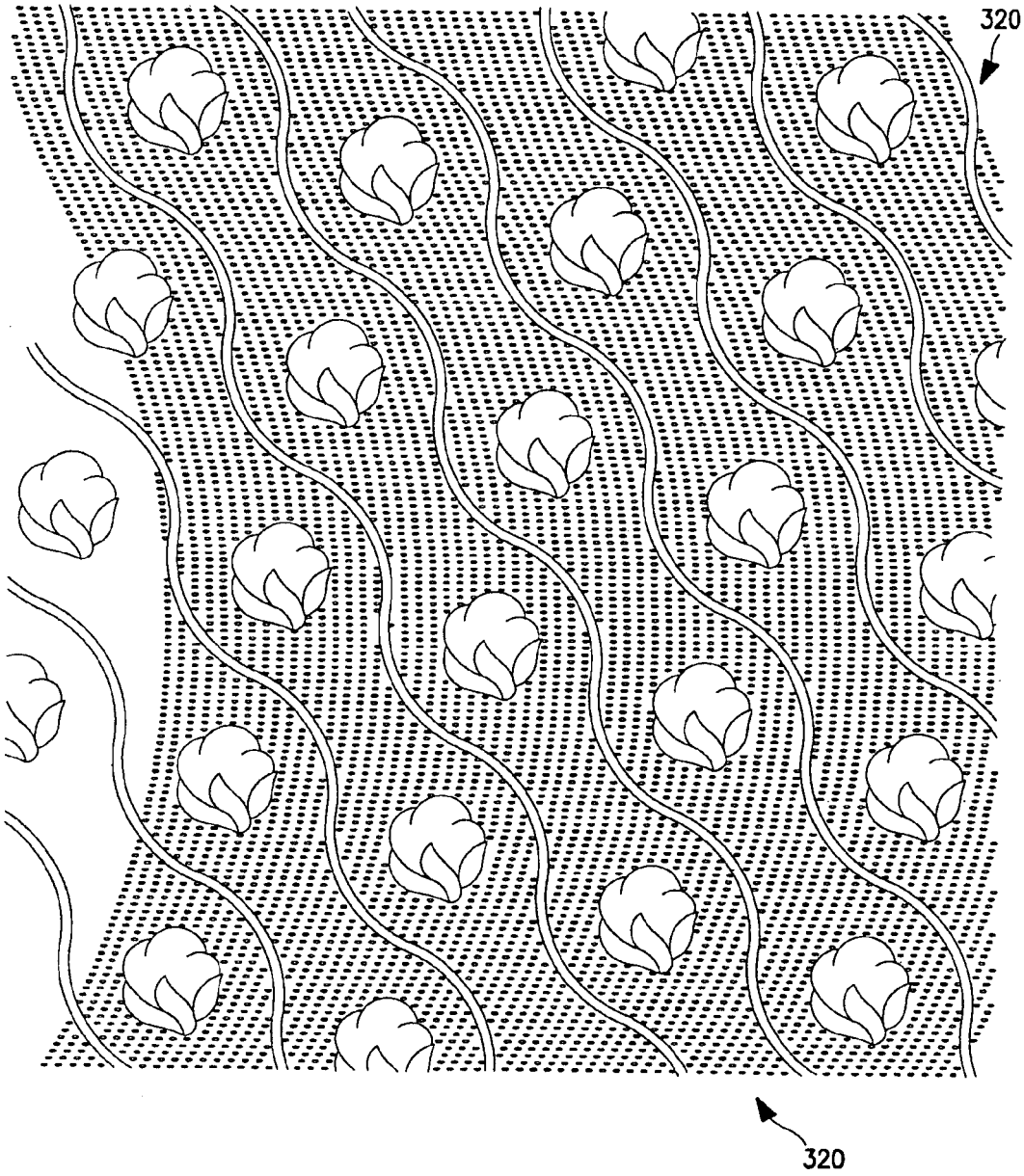

Similar to the embossing pattern shown in FIG. 4, the embossing patterns illustrated in FIGS. 10 and 11 which includes an overall wave-like pattern, can include additional designs and patterns incorporated into the background pattern. For example, various embodiments are shown in FIGS. 12, 13, and 14. For instance, in FIG. 12, an embossing pattern 316 is shown which includes a background pattern similar to the pattern shown in FIG. 10 in addition to diagonal rows of puppies.

In FIG. 13, an embossing pattern 318 is shown that, instead of puppies, includes flowers spaced throughout the background pattern. In FIG. 14, an embossing pattern 320 is shown that includes diagonal rows of flowers separated by wavy lines. All of these patterns are well suited to producing improved tissue products in accordance with the present invention.

When embossing tissue products in accordance with the present invention, as described above, the tissue product can include a single ply or can include multiple plies. When the tissue product contains multiple plies, only a single ply in the product need be embossed in accordance with the present invention for enhancements in the properties of the product to be realized. In other embodiments, however, more than one of the plies can be embossed as described above. The plies can be embossed simultaneously or can be embossed separately and later joined. In multi-ply products, the plies can be attached together through any conventional means, such as through the use of an adhesive or through mechanical interlocking of crimbed fibers from one ply to an adjacent ply.

The present invention may be better understood with respect to the following examples.

EXAMPLE 1

A one-ply base sheet was embossed in accordance with the present invention and wound into rolled products. The base sheet used in this example was a bath tissue having a bone dry basis weight of 19.06 gsm. The base sheet was formed similar to the process illustrated in FIG. 1. The base sheet was formed from a fiber furnish that contained 100% recycled fiber.

Three samples of the base sheet were tested for various properties and the following results were obtained:

| | Sample A | Sample B | Sample C |
|---|---|---|---|
| MD Tensile (N/m) | 212 | 243 | 139 |
| CD Tensile (N/m) | 104 | 108 | 96 |
| GMT | 148 | 162 | 116 |

After being formed and dried, the base sheet was fed through an embossing nip that included a 7.7" diameter bottom pattern roll. The pattern roll was covered with a laser engraved pattern sleeve. In this embodiment, the embossing pattern was similar to that illustrated in FIG. 4. The top roll in contact with the embossing roll coated with a 65 durometer Shore A hardness rubber material (8.02 inch diameter, ⅝ inch rubber thickness).

Various rolled products were produced having varying sheet lengths. The following results were obtained:

| Sample Number | Length (m) | Roll Weight (g) | Diameter (mm) | Kershaw Roll Firmness (mm) | Roll Bulk (cc/)g |
|---|---|---|---|---|---|
| 1 | 34.82 | 75.86 | 122.0 | 8.13 | 15.62 |
| 2 | 34.30 | 74.71 | 118.0 | 7.93 | 14.71 |

-continued

| Sample Number | Length (m) | Roll Weight (g) | Diameter (mm) | Kershaw Roll Firmness (mm) | Roll Bulk (cc/)g |
|---|---|---|---|---|---|
| 3 | 34.82 | 75.85 | 117.0 | 7.37 | 14.21 |
| 4 | 35.25 | 76.80 | 118.0 | 7.37 | 14.31 |
| 5 | 33.88 | 73.80 | 115.5 | 10.03 | 14.18 |
| 6 | 33.99 | 74.05 | 105.0 | 5.17 | 11.33 |
| 7 | 35.48 | 77.30 | 103.0 | 4.17 | 10.37 |
| 8 | 35.61 | 77.57 | 103.0 | 3.80 | 10.33 |
| 9 | 35.23 | 76.76 | 103.0 | 4.30 | 10.44 |
| 10 | 34.69 | 75.57 | 101.0 | 4.13 | 10.12 |
| 11 | 35.78 | 77.94 | 101.0 | 3.63 | 9.81 |
| 12 | 35.43 | 77.19 | 100.0 | 3.60 | 9.68 |
| 13 | 35.12 | 76.51 | 98.0 | 3.50 | 9.30 |
| 14 | 35.48 | 77.30 | 97.5 | 3.47 | 9.09 |
| 15 | 34.85 | 75.92 | 99.5 | 3.90 | 9.72 |
| 16 | 46.92 | 102.21 | 123.0 | 10.30 | 11.81 |
| 17 | 47.28 | 103.01 | 130.0 | 9.77 | 13.26 |
| 18 | 48.13 | 104.85 | 133.0 | 7.63 | 13.71 |
| 19 | 47.74 | 104.01 | 127.0 | 10.00 | 12.47 |
| 20 | 47.76 | 104.05 | 127.0 | 9.13 | 12.47 |
| 21 | 47.15 | 102.72 | 117.0 | 4.43 | 10.49 |
| 22 | 47.32 | 103.09 | 119.0 | 4.27 | 10.87 |
| 23 | 47.83 | 104.20 | 111.5 | 3.67 | 9.26 |
| 24 | 48.34 | 105.31 | 112.5 | 3.80 | 9.36 |
| 25 | 45.26 | 98.60 | 111.5 | 3.43 | 9.79 |
| 26 | 46.93 | 102.23 | 112.0 | 3.77 | 9.54 |
| 27 | 46.93 | 102.23 | 113.0 | 3.60 | 9.74 |
| 28 | 47.21 | 102.84 | 114.0 | 3.67 | 9.88 |
| 29 | 47.68 | 103.87 | 112.0 | 3.63 | 9.39 |
| 30 | 47.32 | 103.08 | 111.0 | 3.60 | 9.27 |
| 31 | 59.40 | 129.40 | 140.0 | 8.57 | 12.43 |
| 32 | 59.71 | 130.09 | 135.5 | 8.67 | 11.51 |
| 33 | 58.95 | 128.43 | 143.0 | 6.07 | 13.12 |
| 34 | 60.04 | 130.79 | 139.0 | 8.83 | 12.11 |
| 35 | 56.43 | 122.93 | 142.5 | 6.77 | 13.60 |
| 36 | 59.50 | 129.63 | 117.0 | 3.00 | 8.32 |
| 37 | 60.35 | 131.47 | 118.0 | 2.93 | 8.36 |
| 38 | 60.71 | 132.27 | 119.5 | 3.17 | 8.55 |
| 39 | 59.52 | 129.67 | 120.5 | 3.27 | 8.89 |
| 40 | 59.84 | 130.37 | 118.0 | 3.03 | 8.43 |
| 41 | 60.33 | 131.43 | 114.0 | 2.67 | 7.73 |
| 42 | 60.47 | 131.73 | 112.5 | 2.67 | 7.48 |
| 43 | 60.19 | 131.13 | 111.0 | 2.40 | 7.28 |
| 44 | 60.84 | 132.54 | 110.0 | 2.33 | 7.06 |
| 45 | 60.86 | 132.59 | 113.0 | 2.50 | 7.51 |
| 46 | 0.00 | 0.00 | 132.0 | 8.77 | |
| 47 | 60.78 | 132.42 | 134.0 | 8.10 | 11.03 |
| 48 | 60.16 | 131.07 | 131.0 | 4.43 | 10.60 |
| 49 | 60.09 | 130.91 | 127.0 | 8.13 | 9.91 |
| 50 | 60.40 | 131.59 | 132.0 | 6.57 | 10.74 |
| 51 | 61.51 | 134.01 | 120.0 | 2.97 | 8.52 |
| 52 | 60.45 | 131.70 | 120.0 | 2.93 | 8.67 |
| 53 | 60.61 | 132.04 | 119.5 | 3.00 | 8.57 |
| 54 | 60.61 | 132.04 | 120.0 | 2.90 | 8.65 |
| 55 | 60.87 | 132.61 | 121.0 | 2.97 | 8.77 |
| 56 | 60.46 | 131.71 | 114.0 | 2.17 | 7.71 |
| 57 | 60.75 | 132.35 | 117.0 | 2.77 | 8.14 |
| 58 | 59.86 | 130.41 | 115.5 | 2.60 | 8.03 |
| 59 | 60.17 | 131.09 | 114.5 | 2.63 | 7.83 |
| 60 | 60.76 | 132.37 | 114.0 | 2.57 | 7.67 |
| 61 | 46.64 | 101.61 | 117.0 | 6.50 | 10.61 |
| 62 | 48.41 | 105.47 | 114.5 | 7.63 | 9.73 |
| 63 | 47.25 | 102.93 | 120.0 | 8.23 | 11.09 |
| 64 | 47.99 | 104.55 | 117.5 | 7.33 | 10.41 |
| 65 | 47.08 | 102.56 | 119.0 | 7.67 | 10.92 |
| 66 | 47.88 | 104.32 | 107.5 | 3.20 | 8.50 |
| 67 | 47.54 | 103.57 | 105.0 | 2.77 | 8.10 |
| 68 | 47.56 | 103.61 | 107.0 | 2.63 | 8.46 |
| 69 | 47.99 | 104.55 | 106.0 | 2.73 | 8.20 |
| 70 | 48.29 | 105.21 | 105.5 | 2.70 | 8.06 |
| 71 | 48.58 | 105.83 | 107.0 | 2.73 | 8.29 |
| 72 | 47.16 | 102.75 | 105.0 | 2.73 | 8.16 |
| 73 | 47.89 | 104.33 | 103.0 | 2.33 | 7.68 |
| 74 | 48.79 | 106.28 | 106.0 | 2.77 | 8.07 |
| 75 | 45.65 | 99.45 | 103.5 | 2.53 | 8.15 |
| 76 | 34.89 | 76.01 | 125.5 | 8.67 | 16.62 |
| 77 | 33.49 | 72.95 | 123.5 | 11.90 | 16.70 |

-continued

| Sample Number | Length (m) | Roll Weight (g) | Diameter (mm) | Kershaw Roll Firmness (mm) | Roll Bulk (cc/)g |
|---|---|---|---|---|---|
| 78 | 33.76 | 73.55 | 118.0 | 8.17 | 14.94 |
| 79 | 34.84 | 75.90 | 124.0 | 11.90 | 16.20 |
| 80 | 35.07 | 76.39 | 119.5 | 10.43 | 14.81 |
| 81 | 34.92 | 76.07 | 104.0 | 3.80 | 10.78 |
| 82 | 35.38 | 77.08 | 99.0 | 3.20 | 9.46 |
| 83 | 34.89 | 76.01 | 100.0 | 3.53 | 9.82 |
| 84 | 35.63 | 77.63 | 102.5 | 3.60 | 10.21 |
| 85 | 35.28 | 76.87 | 101.5 | 3.47 | 10.07 |
| 86 | 35.77 | 77.93 | 100.0 | 3.37 | 9.58 |
| 87 | 35.88 | 78.17 | 100.0 | 3.13 | 9.55 |
| 88 | 35.84 | 78.08 | 98.0 | 2.90 | 9.11 |
| 89 | 36.00 | 78.43 | 96.5 | 2.83 | 8.73 |
| 90 | 35.48 | 77.30 | 101.0 | 3.17 | 9.89 |
| 91 | 60.70 | 132.23 | 129.0 | 3.30 | 10.16 |
| 92 | 60.14 | 131.01 | 131.0 | 3.33 | 10.61 |
| 93 | 60.77 | 132.39 | 124.0 | 3.37 | 9.29 |

EXAMPLE 2

The procedure described in Example 1 was repeated. In this example, however, the embossing pattern was substantially similar to the embossing pattern illustrated FIG. 5. The following results were obtained:

| Sample No. | Sheet Count | Diameter (mm) | Volume (cc) | Bulk (cc/g) | Kershaw Firmness (mm) |
|---|---|---|---|---|---|
| 1 | 325 | 117 | 1078.0 | 14.78 | 9.83 |
| 2 | 325 | 117 | 1078.0 | 14.78 | 10.27 |
| 3 | 325 | 117 | 1078.0 | 14.78 | 10.80 |
| 4 | 325 | 117 | 1078.0 | 14.78 | 9.87 |
| 5 | 325 | 118 | 1099.1 | 15.07 | 10.30 |
| 6 | 375 | 120 | 1141.8 | 13.57 | 6.67 |
| 7 | 375 | 120 | 1141.8 | 13.57 | 6.43 |
| 8 | 375 | 121 | 1163.4 | 13.83 | 6.00 |
| 9 | 375 | 121 | 1163.4 | 13.83 | 6.27 |
| 10 | 375 | 121 | 1163.4 | 13.83 | 6.07 |
| 11 | 425 | 122 | 1185.2 | 12.43 | 5.87 |
| 12 | 425 | 122 | 1185.2 | 12.43 | 5.93 |
| 13 | 425 | 122 | 1185.2 | 12.43 | 5.57 |
| 14 | 425 | 122 | 1185.2 | 12.43 | 5.37 |
| 15 | 425 | 122 | 1185.2 | 12.43 | 5.63 |
| 16 | 475 | 115 | 1036.3 | 9.72 | 3.93 |
| 17 | 475 | 116 | 1057.1 | 9.92 | 3.93 |
| 18 | 475 | 116 | 1057.1 | 9.92 | 4.20 |
| 19 | 475 | 116 | 1057.1 | 9.92 | 4.17 |
| 20 | 475 | 116 | 1057.1 | 9.92 | 3.83 |
| 21 | 475 | 117 | 1078.0 | 10.11 | 4.00 |
| 22 | 425 | 120 | 1141.8 | 11.97 | 5.10 |
| 23 | 425 | 120 | 1141.8 | 11.97 | 4.87 |
| 24 | 425 | 120 | 1141.8 | 11.97 | 5.03 |
| 25 | 425 | 117 | 1078.0 | 11.30 | 5.13 |
| 26 | 425 | 117 | 1078.0 | 11.30 | 4.70 |
| 27 | 425 | 116 | 1057.1 | 11.09 | 4.97 |
| 28 | 425 | 116 | 1057.1 | 11.09 | 4.67 |
| 29 | 425 | 117 | 1078.0 | 11.30 | 4.97 |

EXAMPLE 3

For comparative purposes, various commercially available bath tissues were tested for various properties. All of the bath tissues reported here have a geometric mean tensile strength of less than 1,400 g/3 inches. None of the samples comprised through-air dried webs. The following results were obtained:

TABLE 3

GLOBAL BATH TISSUE PRODUCT DESIGN

| Manufacturer | Brand | Plies (number) | Roll Bulk (cc/gm) | Caliper 10-sheet (mm) | Roll Firmness (mm) | Sheet Stratification | BD Basis Weight (gsm) | MD-Dry Tensile (gmf/ 76.2 mm) | CD-Dry Tensile (gmf/ 76.2 mm) | GMT (gmf/ 76.2 mm) |
|---|---|---|---|---|---|---|---|---|---|---|
| 1 Potlatch | Soft Choice | 2 | 10.14 | | 8 | Layered | 39.05 | 746 | 324 | 492 |
| 2 Kimberly-Clark | Joy | 1 | 10.05 | | 5.58 | Blended | 18.75 | 1039 | 273 | 533 |
| 3 CMPC | Elite | 1 | 8.00 | | 22.47 | Blended | 22.69 | 752 | 404 | 551 |
| 4 P&G | Charmin | 2 | 7.33 | 2.72 | 4.33 | Blended | 36.42 | 814 | 399 | 570 |
| 5 Kimberly-Clark | Mas | 1 | 8.74 | 2.39 | 6.5 | Blended | 22.55 | 1185 | 314 | 610 |
| 6 Kimberly-Clark | Camelia | 1 | 8.58 | 1.83 | 3.25 | Blended | 19.25 | 996 | 406 | 636 |
| 7 Kimberly-Clark | Mas | 2 | 9.36 | | 4.22 | Blended | 30.00 | 1196 | 348 | 645 |
| 8 P&G | Charmin | 2 | 7.73 | | 4.57 | Blended | 29.38 | 961 | 473 | 674 |
| 9 Irving Tissue | SoftWeve | 1 | 5.54 | 0.99 | 1.8 | Blended | 15.31 | 1013 | 497 | 710 |
| 10 Kimberly-Clark | Kirkland Signature | 2 | 6.64 | 2.18 | 4.30 | Blended | 31.41 | 1136 | 445 | 711 |
| 11 Kimberly-Clark | Neve | 2 | 7.52 | | 3.63 | Blended | 28.7 | 1368 | 372 | 713 |
| 12 Irving Tissue | SoftWeve | 1 | 6.51 | 1.09 | 3.2 | Blended | 14.27 | 1064 | 496 | 726 |
| 13 Kimberly-Clark | Target | 2 | 7.78 | 2.41 | 2.87 | Blended | 31.15 | 1019 | 520 | 728 |
| 14 Berli Jucker Cellox | Zilk | 2 | 15.11 | | 7.47 | Blended | 27.82 | 1318 | 413 | 738 |
| 15 Melhoramentos | Fofura | 2 | 6.62 | | 3.68 | Blended | 30.86 | 1158 | 478 | 744 |
| 16 Ecuapel | Sutil | 1 | 8.88 | | 3.53 | Blended | 16.98 | 786 | 714 | 749 |
| 17 Fort James | Northern | 2 | 7.04 | | 6.4 | | 40.71 | 1165 | 504 | 766 |
| 18 Kimberly-Clark | Member's Mark | 2 | 7.96 | 2.61 | 4.50 | Blended | 30.52 | 1114 | 529 | 768 |
| 19 Copamex | Regio | 2 | 9.05 | 3.44 | 5.9 | Blended | 30.39 | 1193 | 505 | 776 |
| 20 Kimberly-Clark | Cottonelle | 2 | 6.20 | | 2.83 | Blended | 29.71 | 1330 | 454 | 777 |
| 21 Fort James | Member's Mark | 2 | 5.97 | 2.21 | 4.00 | Blended | 34.66 | 1154 | 528 | 781 |
| 22 Kimberly-Clark | Top | 1 | 8.61 | 1.67 | 7.6 | Blended | 19.23 | 1117 | 550 | 784 |
| 23 Fort James | Soft n Gentle | 2 | 8.80 | 2.41 | 7.4 | Blended | 28.38 | 1225 | 512 | 792 |
| 24 Fort James | Northern | 2 | 6.92 | | 7.10 | Blended | 33.79 | 1230 | 512 | 794 |
| 25 Kimberly-Clark | Kleenex | 2 | 7.98 | 2.36 | 4.34 | Blended | 30.54 | 1180 | 543 | 800 |
| 26 | White Cloud | 2 | 6.96 | 2.15 | 5.70 | Blended | 32.57 | 1358 | 481 | 808 |
| 27Kimberly-Clark | Kleenex | 2 | 8.95 | 2.69 | 5.83 | Blended | 32.96 | 1444 | 475 | 828 |
| 28Melhoramentos | Sublime | 1 | 10.94 | | 4.75 | Blended | 19.27 | | | |
| 29Kimberly-Clark | SPLE | 2 | 8.52 | 3.05 | 6.4 | Layered | 35.52 | 1249 | 574 | 847 |
| 30Kimberly-Clark | Scott | 1 | 5.59 | 1.04 | 2.9 | Blended | 17.62 | 1180 | 635 | 866 |
| 31Pro Higie | ECO | 2 | | | 4.78 | Blended | 33.41 | 1061 | 711 | 869 |
| 32PSP | Suave | 1 | | | 3.94 | Blended | 20.48 | 998 | 760 | 871 |
| 33Fort James | Kirkland Signature | 2 | 6.68 | 2.18 | 3.80 | Blended | 29.08 | 1396 | 548 | 875 |
| 34Potlatch | Vons, Luckys | 1 | 6.99 | 1.02 | 3.5 | Blended | 14.91 | 1410 | 547 | 878 |
| 35Potlatch | Soft Choice | 2 | 9.56 | 2.89 | 7.70 | Layered | 33.83 | 1270 | 612 | 882 |
| 36CMPC | Noble | 1 | 8.58 | | 3.89 | Blended | 20.78 | 1203 | 656 | 888 |
| 37Kimberly-Clark | Scott | 2 | 5.37 | | | Blended | 29.33 | 1456 | 549 | 894 |
| 38Marcal | Marcal | 1 | 6.25 | 1.14 | 4.8 | Blended | 16.25 | 1397 | 577 | 898 |
| 39SCA Hygiene Products | Softee | 2 | 9.17 | | 6.02 | Blended | 27.14 | 1614 | 503 | 901 |
| 40Berli Jucker Cellox | Cellox | 2 | 11.50 | | 5.87 | Blended | 28.08 | 1468 | 566 | 912 |
| 41Georgia Pacific | Angel Soft | 2 | 6.25 | 2.29 | 6.70 | Blended | 37.32 | 1585 | 548 | 932 |
| 42Kimberly-Clark | Fresh | 1 | 7.86 | | 4.95 | Blended | 22.79 | 1350 | 653 | 939 |
| 43CarterHoltHarvey | Purex | 2 | 10.83 | 2.82 | 5.04 | Blended | 31.08 | 1517 | 600 | 954 |
| 44Plainwell | Wal Mart | 2 | 8.88 | 2.90 | 7.7 | Blended | 29.13 | 1798 | 512 | 959 |
| 45Kimberly-Clark | Clavel | 2 | 7.74 | | 4.06 | Blended | 29.98 | 1650 | 567 | 967 |
| 46Kimberly-Clark | Nice | 1 | 8.12 | 1.68 | 4.17 | Blended | 20.36 | 1198 | 781 | 967 |
| 47Kimberly-Clark | Scott | 2 | 13.08 | 3.40 | 8.67 | Blended | 35.6 | 1594 | 590 | 970 |
| 48Kimberly-Clark | Sunny | 1 | 9.56 | | 4.09 | Blended | 20.00 | 1409 | 674 | 975 |
| 49Kimberly-Clark | Neve | 2 | 7.35 | 2.41 | 5.8 | Blended | 28.46 | 1784 | 587 | 1023 |
| 50Kimberly-Clark | Kleenex | 1 | 8.01 | | 3.86 | Blended | 21.77 | 1105 | 950 | 1025 |
| 51P&G | Codi | 2 | 7.51 | | 3.97 | Blended | 27.1 | 1634 | 651 | 1031 |
| 52Kimberly-Clark | Scott | 2 | 10.96 | | 5.76 | | 28.96 | 1530 | 711 | 1043 |
| 53Santher | Personal | 2 | 8.34 | | 4.36 | Blended | 34.03 | 1431 | 766 | 1047 |
| 54Santher | Personal | 1 | 9.00 | 2.01 | 4.64 | Blended | 20.34 | 1511 | 730 | 1050 |
| 55Kimberly-Clark | Kleenex | 2 | 7.62 | | 4.06 | Blended | 32.48 | 1347 | 826 | 1055 |
| 56Kimberly-Clark | Sanex | 2 | 7.97 | | 3.71 | Blended | 30.31 | 1610 | 713 | 1071 |
| 57 | Cutie | 2 | 12.09 | | 7.67 | | 41.12 | 2013 | 579 | 1080 |
| 58CMPC | Confort | 1 | 9.48 | | 21.15 | Blended | 22.46 | 1512 | 795 | 1096 |
| 59Kimberly-Clark | Suave | 2 | 7.90 | | 4.34 | Blended | 27.44 | 1501 | 819 | 1109 |
| 60Kimberly-Clark | Flor | 2 | 9.57 | | 4.80 | Blended | 30.83 | 2160 | 580 | 1119 |
| 61Kimberly-Clark | Popee | 2 | 7.75 | 2.64 | 4.13 | Blended | 29.32 | 1586 | 794 | 1122 |
| 62Kimberly-Clark | Wondersoft | 2 | 9.89 | 2.79 | 4.22 | Blended | 28.68 | 1449 | 925 | 1158 |
| 63Kimberly-Clark | Caricia | 1 | 9.49 | | 3.93 | Blended | 17.77 | 1572 | 864 | 1165 |
| 64Kimberly-Clark | Neve | 2 | 9.94 | | 5.02 | Blended | 28.04 | 2074 | 682 | 1189 |
| 65Santher | Personal | 2 | 7.90 | | 2.79 | Blended | 27.63 | 1719 | 864 | 1219 |
| 66CMPC | Elite | 2 | 7.64 | | 3.56 | Blended | 29.39 | 1652 | 931 | 1240 |
| 67CMPC | Elite | 2 | 7.64 | | 3.56 | Blended | 29.39 | 1652 | 931 | 1240 |
| 68Kimberly-Clark | Suave | 2 | 11.51 | | 5.36 | Blended | 30.42 | 2126 | 784 | 1291 |
| 69 | Vinda | 2 | 7.42 | 2.69 | 3.80 | Blended | 32.34 | 2193 | 851 | 1366 |

Figure 15:
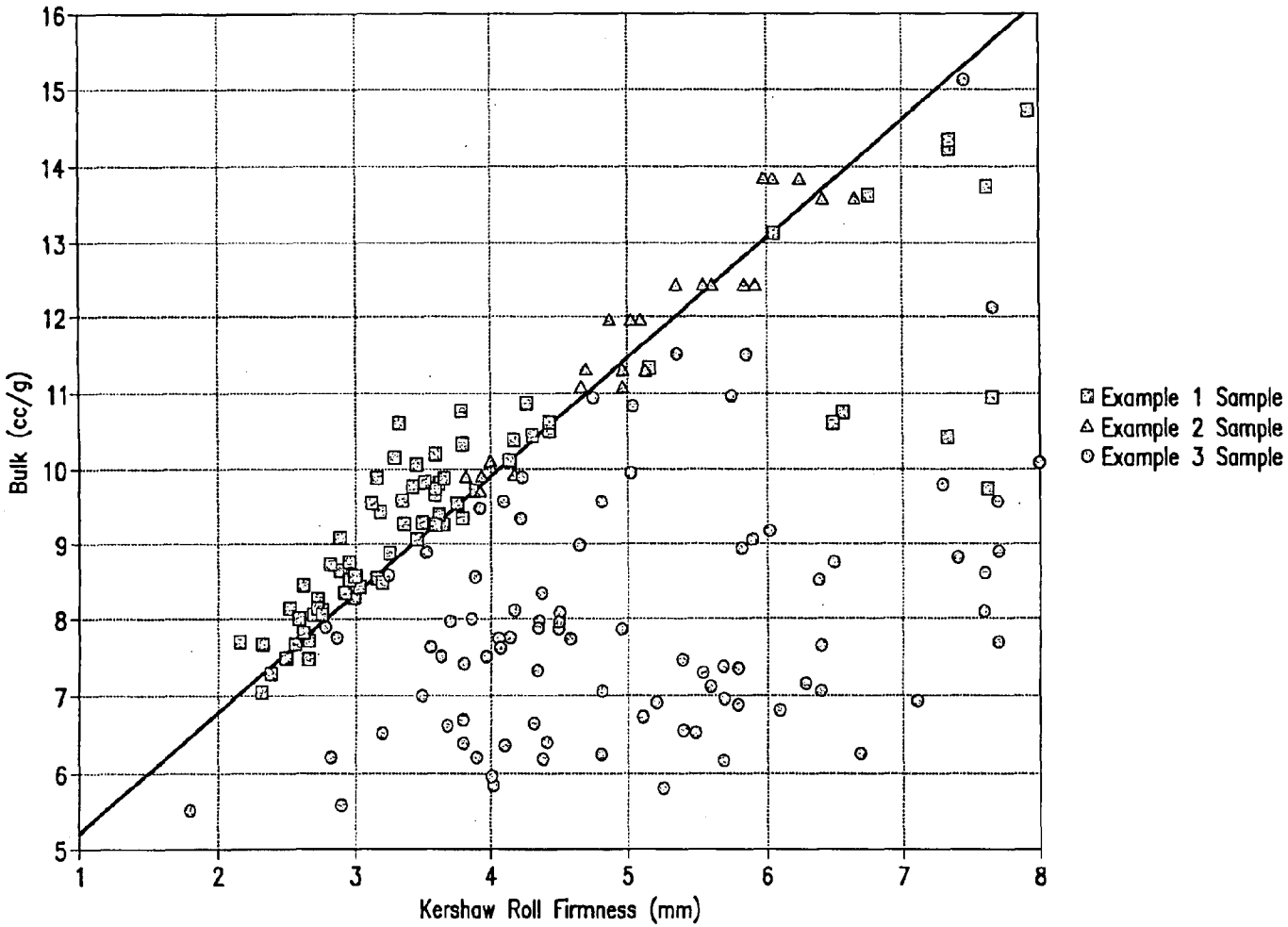
FIG. 15 is a graphical representation of the results contained in the Examples below as compared to the prior art.
Figure 16:
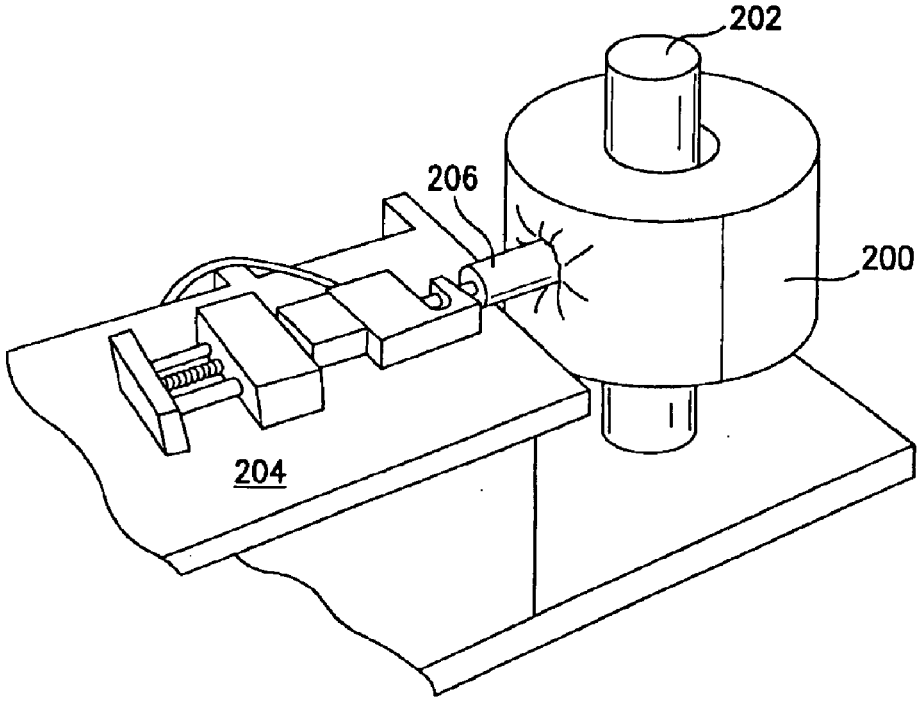
FIG. 16 is a perspective view of an apparatus for determining roll firmness.

All of the results obtained in Example 1, Example 2, and Example 3 above were plotted on a graph of roll bulk (cc/g) versus Kershaw roll firmness (mm). The graph is presented as FIG. 15. For a point of reference, the graph shown in FIG. 15 also includes a line as illustrated in FIG. 3 which has the following mathematical relationship:

$$\text{Roll bulk } (cm^3/g) > 1.55 * \text{Kershaw Roll Firmness}(g) + 3.7.$$

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A rolled tissue product comprising:

a base sheet spirally wound into a roll comprising at least one ply, the ply having a basis weight of from about 10 gsm to about 40 gsm, the ply comprising pulp fibers, the ply not being through-air dried; and wherein the ply defines a background embossing pattern formed therein such that the ply has a geometric mean tensile strength of less than about 1,400 g/3 inches and the wound roll has a roll bulk in relation to a Kershaw roll firmness such that:

$$\text{Roll bulk } (cm^3/g) > 1.55 * \text{Kershaw Roll Firmness}(g) + 3.7.$$

2. A rolled tissue product as defined in claim 1, wherein the base sheet comprises a single ply.

3. A rolled tissue product as defined in claim 1, wherein the base sheet comprises two plies.

4. A rolled tissue product as defined in claim 3, wherein the two plies have been embossed together.

5. A rolled tissue product as defined in claim 1, wherein the background pattern covers at least 75 percent of the surface area of one side of the ply.

6. A rolled tissue product as defined in claim 1, wherein the background pattern covers at least 90 percent of the surface area of one side of the ply.

7. A rolled tissue product as defined in claim 1, wherein the ply has been embossed in a dry state.

8. A rolled tissue product as defined in claim 1, wherein the background pattern comprises a pattern of discrete shapes, the discrete shapes being present in an amount of at least 50 shapes per square inch.

9. A rolled tissue product as defined in claim 8, wherein the discrete shapes are present in an amount of from about 150 to about 250 shapes per square inch.

10. A rolled tissue product as defined in claim 8, wherein the discrete shapes have a maximum dimension of from about 0.03 inches to about 0.10 inches.

11. A rolled tissue product as defined in claim 8, wherein the discrete shapes appear in rows, the shapes being spaced from about 0.055 inches to about 0.075 inches apart in each row from a center of one shape to a center of an adjacent shape.

12. A rolled tissue product as defined in claim 11, wherein the rows are spaced from about 0.06 inches to about 0.14 inches apart from a center of one row to a center of an adjacent row.

13. A rolled tissue product as defined in claim 11, wherein the discrete shapes appearing in adjacent rows are offset.

14. A rolled tissue product as defined in claim 11, wherein the rows form a wave-like pattern.

15. A rolled tissue product as defined in claim 14, wherein the wave-like pattern comprises sine waves.

16. A rolled tissue product as defined in claim 8, wherein the discrete shapes comprise indentations in the ply.

17. A rolled tissue product as defined in claim 8, wherein the background pattern is combined with an additional embossing pattern.

18. A rolled tissue product as defined in claim 1, wherein the embossed ply has been creped.

19. A rolled tissue product as defined in claim 1, wherein the product has a roll bulk of from about 5 to about 17.

20. A process for producing a rolled tissue product comprising:

providing a base sheet comprising at least one ply, the ply having a basis weight of from about 10 gsm to about 40 gsm, the ply comprising pulp fibers, the ply not being through-air dried;

embossing the ply according to a background embossing pattern, the embossed ply having a geometric mean tensile strength of less than about 1,400 g/3 inches; and winding the base sheet into a wound roll, wherein the ply has been embossed in such a manner that the wound roll has a roll bulk in relation to a Kershaw roll firmness such that:

$$\text{Roll bulk } (cm^3/g) > 1.55 * \text{Kershaw Roll Firmness}(g) + 3.7.$$

21. A process as defined in claim 20, wherein the base sheet only includes the one embossed ply.

22. A process as defined in claim 20, wherein the background pattern covers at least 75 percent of the surface area of one side of the ply.

23. A process as defined in claim 20, wherein the background pattern covers at least 90 percent of the surface area of one side of the ply.

24. A process as defined in claim 20, wherein the ply is embossed in a substantially dry state.

25. A process as defined in claim 20, wherein the background pattern comprises a pattern of discrete shapes, the discrete shapes being present in an amount of at least 50 shapes per square inch.

26. A process as defined in claim 25, wherein the discrete shapes are present in an amount of at least about 150 to about 250 shapes per square inch.

27. A process as defined in claim 25, wherein the shapes have a maximum dimension of from about 0.03 inches to about 0.10 inches.

28. A process as defined in claim 25, wherein the discrete shapes appear in rows, the shapes being spaced from about 0.055 inches to about 0.075 inches apart in each row from a center of one shape to a center of an adjacent shape.

29. A process as defined in claim 28, wherein the rows are spaced from about 0.06 inches to about 0.14 inches apart from a center of one row to a center of an adjacent row.

30. A process as defined in claim 28, wherein the discrete shapes appearing in adjacent rows are offset.

31. A process as defined in claim 28, wherein the rows are in a wave-like pattern.

32. A process as defined in claim 25, wherein the background pattern is combined with an additional pattern.

33. A process as defined in claim 20, wherein the ply of the base sheet has been creped.

34. A process as defined in claim 20, wherein the wound roll has a roll bulk of from about 5 to about 17.

35. A rolled tissue product comprising:

a base sheet spirally wound into a roll comprising at least one ply, the ply comprising pulp fibers; and an embossed pattern formed into the ply according to a background pattern, the background pattern comprising a pattern of discrete shapes, the discrete shapes being present in an amount of at least 50 shapes per square inch, the shapes having a maximum dimension of from about 0.03 inches to about 0.10 inches, the discrete shapes appearing in rows, the shapes being spaced from about 0.04 inches to about 0.09 inches apart in each row from a center of one shape to a center of an adjacent shape, the rows being spaced from about 0.06 inches to about 0.14 inches apart from a center of one row to a center of an adjacent row, and wherein the wound roll has a roll bulk in relation to a Kershaw roll firmness such that:

$$\text{Roll bulk } (cm^3/g) > 1.55 * \text{Kershaw Roll Firmness}(g) + 3.7.$$

36. A rolled tissue product as defined in claim 35, wherein the ply has a basis weight of from about 10 gsm to about 40 gsm, the ply not being through-air dried, the ply having been creped.

37. A rolled tissue product as defined in claim 35, wherein the background pattern covers at least 75 percent of the surface area of one side of the ply.

38. A rolled tissue product as defined in claim 35, wherein the ply has been embossed in a dry state.

39. A rolled tissue product as defined in claim 35, wherein the rows of the background pattern form a wave-like pattern.

40. A rolled tissue product as defined in claim 35, wherein the rolled product has a roll bulk of from about 7 to about 15.

* * * * *